US009324488B2

(12) United States Patent
Dayton

(10) Patent No.: US 9,324,488 B2
(45) Date of Patent: Apr. 26, 2016

(54) SOLENOID ASSEMBLY

(71) Applicant: Eaton Corporation, Cleveland, OH (US)

(72) Inventor: Robert A. Dayton, Attica, MI (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 14/486,455

(22) Filed: Sep. 15, 2014

(65) Prior Publication Data

US 2015/0061799 A1 Mar. 5, 2015

Related U.S. Application Data

(63) Continuation of application No. PCT/US2013/029758, filed on Mar. 8, 2013.

(60) Provisional application No. 61/616,631, filed on Mar. 28, 2012, provisional application No. 61/664,926, filed on Jun. 27, 2012, provisional application No. 61/761,445, filed on Feb. 6, 2013.

(51) Int. Cl.

| | |
|---|---|
| ***H01F 3/00*** | (2006.01) |
| ***H01F 7/08*** | (2006.01) |
| ***H01F 7/18*** | (2006.01) |
| ***H01F 7/16*** | (2006.01) |
| ***H01F 7/126*** | (2006.01) |

(Continued)

(52) U.S. Cl.

CPC ..... *H01F 7/18* (2013.01); *H01F 7/081* (2013.01); *H01F 7/126* (2013.01); *H01F 7/128* (2013.01); *H01F 7/16* (2013.01); *H01F 2007/062* (2013.01)

(58) Field of Classification Search

CPC ..... H01F 7/081; H01F 7/16; H01F 7/126; H01F 7/128; H01F 7/18; H01F 2007/062

USPC ..... 335/279–281, 187, 203

See application file for complete search history.

(56) References Cited

U.S. PATENT DOCUMENTS

| | | | | | |
|---|---|---|---|---|---|
| 4,633,209 | A * | 12/1986 | Belbel | H01F 7/1638 | 335/251 |
| 5,066,980 | A * | 11/1991 | Schweizer | H01F 7/13 | 335/255 |
| 5,423,117 | A * | 6/1995 | Okada | H01F 7/06 | 264/272.19 |

(Continued)

FOREIGN PATENT DOCUMENTS

| | | | |
|---|---|---|---|
| EP | 1158157 | A2 | 11/2001 |
| EP | 1574770 | A1 | 9/2005 |
| EP | 1903581 | A2 | 3/2008 |

OTHER PUBLICATIONS

International Search Report for International Publication No. PCT/US2013/029758, European Patent Office as Search Authority, Mailed Jun. 6, 2013.

*Primary Examiner* — Bernard Rojas

(74) *Attorney, Agent, or Firm* — Quinn Law Group, PLLC

(57) ABSTRACT

A solenoid assembly includes a coil assembly having a coil and a bobbin surrounding the coil. A first post extends from the bobbin. Electrical current is supplied to the coil through the first post. An armature at least partially surrounds the coil assembly and is configured so that the first post extends through the armature. The armature is configured to translate relative to the pole piece when the coil is energized. A feature is configured to prevent the armature from contacting the first post when the armature translates.

20 Claims, 14 Drawing Sheets

(51) Int. Cl.
*H01F 7/128* (2006.01)
*H01F 7/06* (2006.01)

(56) References Cited

U.S. PATENT DOCUMENTS 6,064,289 A 5/2000 Wieloch et al.
6,424,244 B1 * 7/2002 Hendel ..... H01H 51/2209 335/177
6,918,571 B1 7/2005 Rose
7,209,020 B2 * 4/2007 Telep ..... H01F 7/1607 335/255
8,344,837 B2 * 1/2013 Niimi ..... H01H 51/065 335/281

* cited by examiner

SOLENOID ASSEMBLY

CROSS-REFERENCE TO RELATED APPLICATIONS

This application is a bypass continuation application of International Application No. PCT/US2013/029758 filed Mar. 8, 2013, which claims priority to U.S. Provisional Application No. 61/616,631 filed Mar. 28, 2012, U.S. Provisional Application No. 61/664,926 filed Jun. 27, 2012, and U.S. Provisional Application No. 61/761,445 filed Feb. 6, 2013.

TECHNICAL FIELD

The present teachings generally include a solenoid assembly with an armature and a pole piece.

BACKGROUND

Solenoid assemblies have an energizable coil that is selectively energizable to move an armature by magnetic flux. Movement of the armature can produce a desired result that is dependent upon the particular application of the solenoid assembly. For example, the armature may be connected to a valve that controls the hydraulic fluid supplied to another component. Ball bearings are sometimes used in solenoid valves to increase the smoothness of motion of the armature.

SUMMARY

A solenoid assembly is provided in which electrical energy is supplied to a coil through a post that extends through an armature. The assembly prevents hysteresis that can be caused by contact of the armature with other components. Specifically, the solenoid assembly includes a coil assembly having a coil, with a pole piece and an armature at least partially surrounding the coil. The armature is configured to translate relative to the pole piece when the coil is energized. The coil assembly has a bobbin at least partially surrounding the coil and a first post that extends from the bobbin. Electrical current is supplied to the coil through the first post. The armature is configured so that the first post extends through the armature. A feature is configured to prevent the armature from contacting the first post when the armature translates. The feature can be referred to as an anti-hysteresis feature as it prevents hysteresis due to contact of the armature with other components.

In one aspect of the present teachings, the solenoid assembly includes a substantially tubular member press-fit to the pole piece at a periphery of the pole piece to surround the pole piece, the armature, and the coil assembly radially outward of the coil assembly. The tube, the armature, and the pole piece provide a magnetic flux path surrounding the coil when the coil is energized. The pole piece and the armature can each be a single component of powdered metal. Alternatively, the pole piece and the armature can each be multi-piece stampings, each having a hub and a flange.

In one aspect of the present teachings, the feature can be an anti-rotation feature that is in contact with the armature and is configured to prevent rotation of the armature about the center axis, thereby preventing contact of the armature with the post when the armature translates. For example, the anti-rotation feature could be a ball bearing positioned between and contacting both the housing and an outer wall of the armature, and configured to ride along the armature as the armature moves.

In another aspect of the present teachings, the opening in the armature is a first opening, and the coil assembly has a second post. The armature has a second opening through which the second post extends. The feature is a sleeve on one of the first post and the second post. The sleeve contacts the armature when the armature rotates, thereby preventing the armature from contacting the first post and the second post. The sleeve can be steel, presenting less friction on the moving armature than would the posts, which can be plastic. By reducing friction, the sleeve thus lessens hysteresis.

In another aspect of the present teachings, a solenoid assembly is provided that has a flux path traveling only through an armature and a pole piece. This is accomplished by configuring the armature and the pole piece so that each extends both radially inward and radially outward of the coil.

By configuring the solenoid assembly so that electrical current is provided to the coil along a post that extends through the armature, electrical current need not be provided through the side of the solenoid housing, enabling the solenoid assembly to be mounted in a more compact packaging space. Contact of the armature with the posts or friction between the armature and the posts could cause hysteresis, which would reduce the strength of the flux path and the force on the pin created by the flux path. By preventing such contact with an anti-rotation feature, or by minimizing friction on the armature, such as by use of the sleeve to prevent contact with the post, the amount of movement of the armature is reliably controlled by the amount of electrical current supplied to the coil.

The above features and advantages and other features and advantages of the present teachings are readily apparent from the following detailed description of the best modes for carrying out the present teachings when taken in connection with the accompanying drawings.

DETAILED DESCRIPTION

Figure 1:
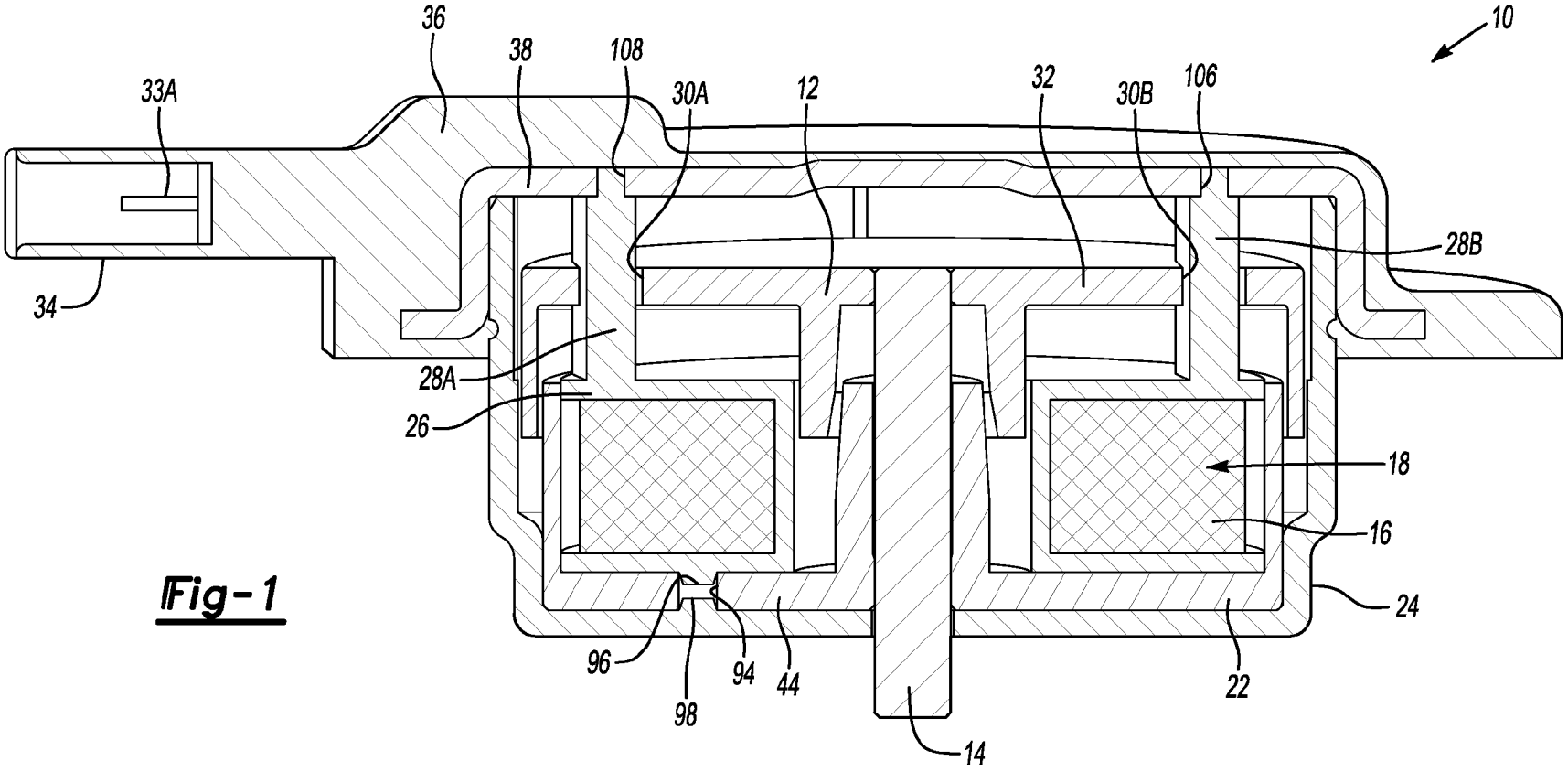
FIG. 1 is a schematic illustration in cross-sectional view of a solenoid assembly in one aspect of the present teachings, taken at lines 1-1 in FIG. 3.

Referring to the drawings, wherein like reference numbers refer to like components throughout the views, FIG. 1 shows a solenoid assembly 10 with a movable armature 12 that moves a pin 14. The pin 14 can be attached to a valve or other component such as to control fluid flow. The pin 14 may be moved with a variable force dependent on electrical current provided to a coil 16 of a coil assembly 18. The solenoid assembly 10 is configured so that a flux path 20, shown in FIG. 2, that is established by magnetic flux created when the coil 16 is energized travels only through the armature 12 and a pole piece 22. This reduces the number of components and simplifies the solenoid assembly 10 because flux collectors are not required, and because a solenoid housing 24 that contains the armature 12, the coil assembly 18 and the pole piece 22 does not need to be configured to form a portion of the flux path. As such, the solenoid housing 24 need not be magnetic or magnetizable, and so can be formed of a variety of nonmagnetic materials, such as an aluminum alloy or plastic.

Figure 3:
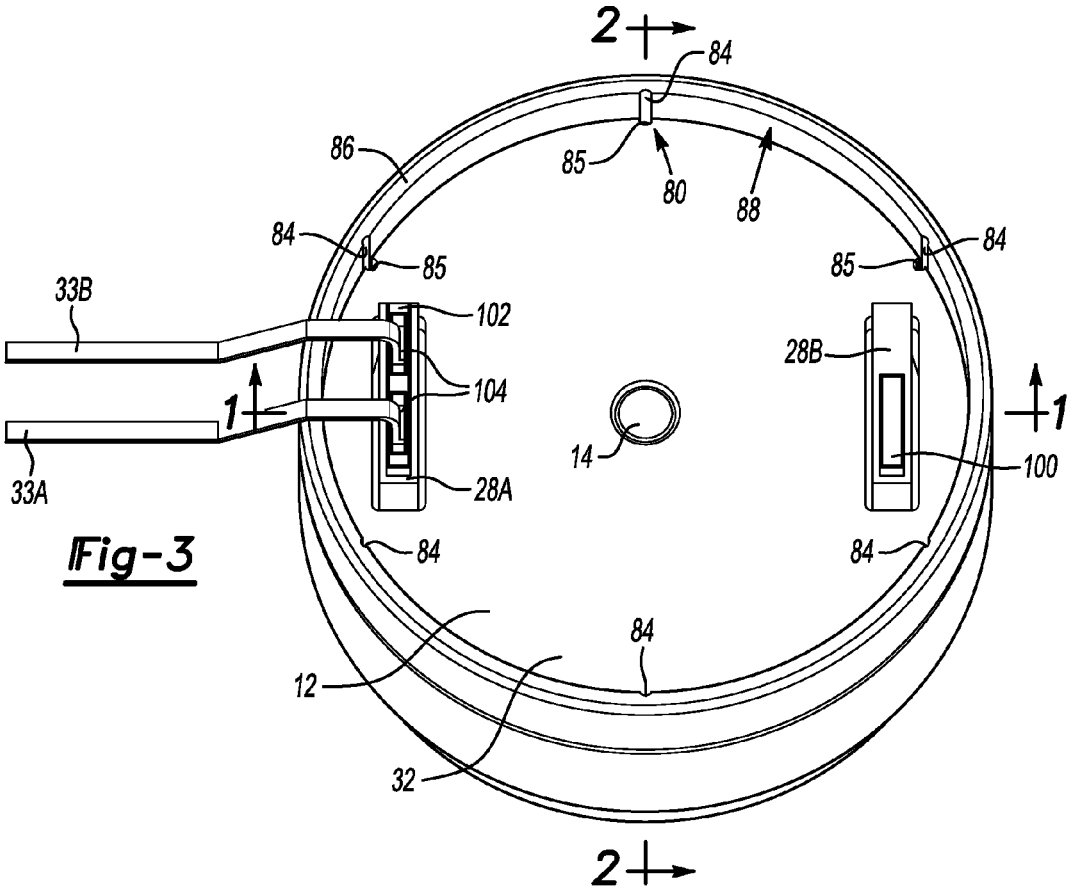
FIG. 3 is a schematic perspective illustration of the solenoid assembly of FIGS. 1 and 2 with a cap and an overmolded portion removed.
Figure 4:
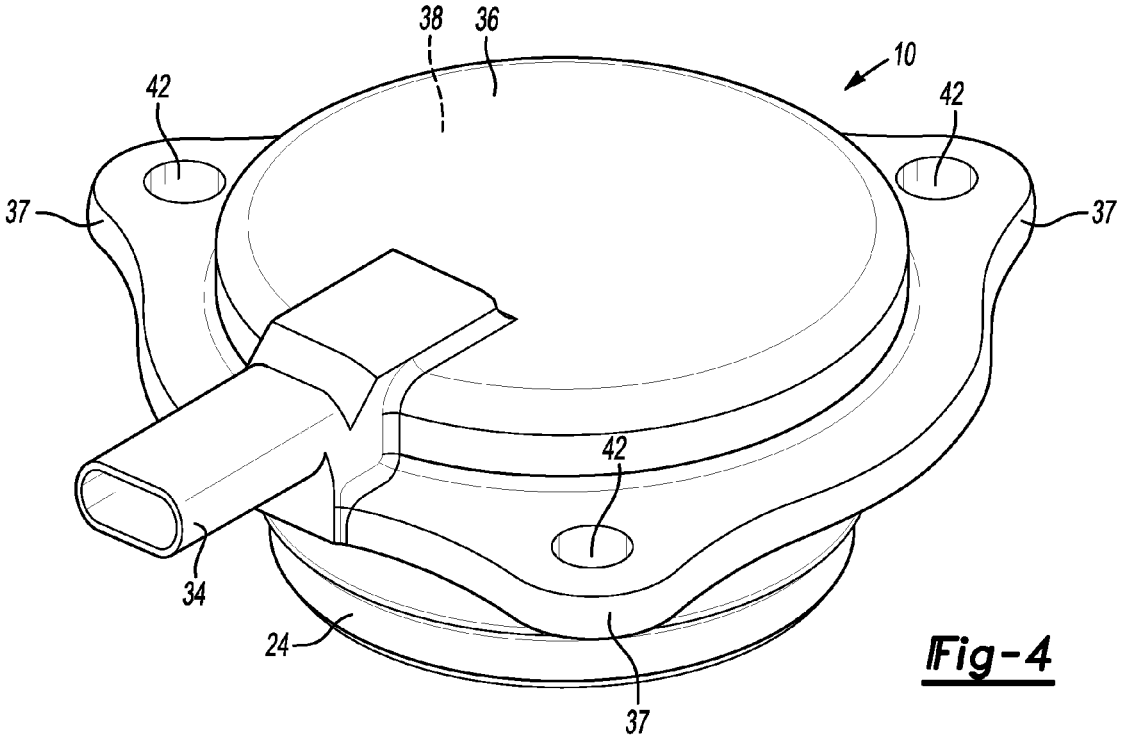
FIG. 4 is a schematic perspective illustration of the solenoid assembly of FIGS. 1-3.
Figure 5:
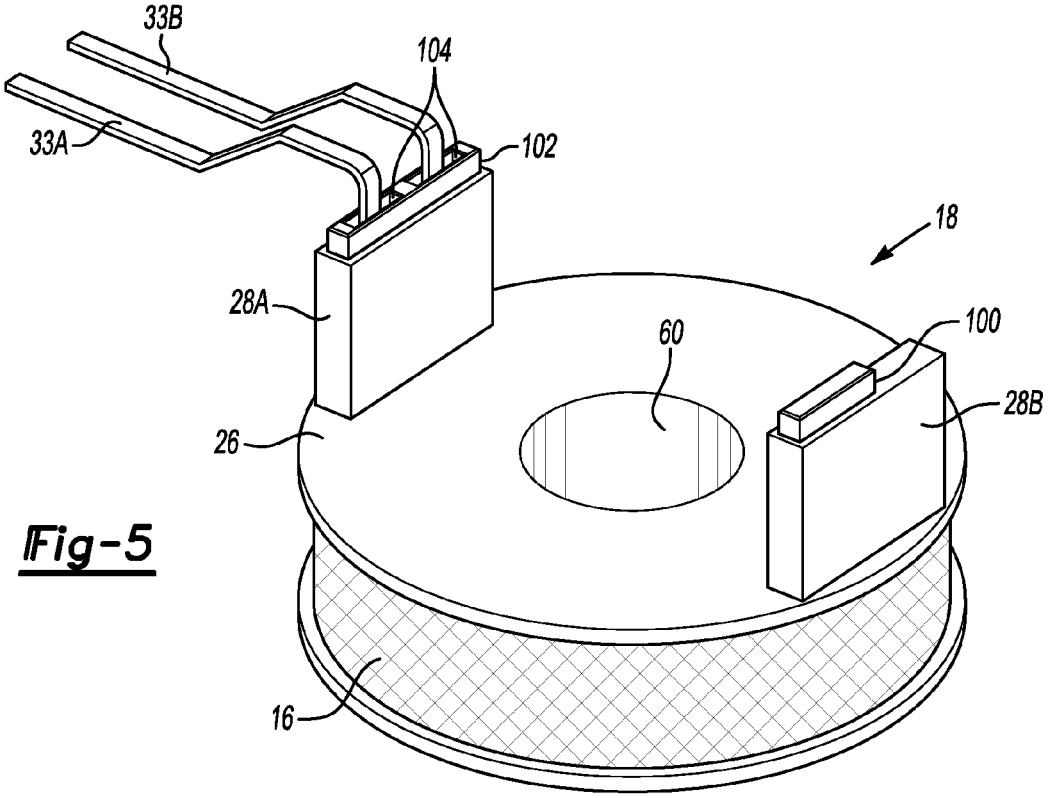
FIG. 5 is a schematic illustration in perspective view of a coil assembly included in the solenoid assembly of FIGS. 1-4 with the cap, the overmolded portion, and a housing removed.

As best shown in FIGS. 1 and 3, the coil assembly 18 includes a bobbin 26 around which the coil 16 is wound. The bobbin 26 includes integral first and second posts 28A, 28B that extend through first and second openings 30A, 30B in a base 32 of the armature 12. The base 32 is referred to herein as a second base. Electrical terminals 33A, 33B extend from an electrical connector 34 through an overmolded portion 36 of a cap 38 and along the first post 28A to the coil 16. The overmolded portion 36 flows into a recess 39 around the housing 24 to help retain the overmolded portion 36 to the housing 24. FIG. 4 shows the overmolded portion 36 forms the electrical connector 34 and has flanges 37 with fastener openings 42 that permit the solenoid assembly 10 to be mounted to a component that receives the pin 14. The cap 38 is press-fit to the posts 28A, 28B to retain the pole piece 22 against the housing 24 and the bobbin 26 press-fit against the pole piece 22. The cap 38 and the housing 24 together define a cavity 40 in which the pole piece 22, coil assembly 18 and armature 12 are located.

Figure 2:
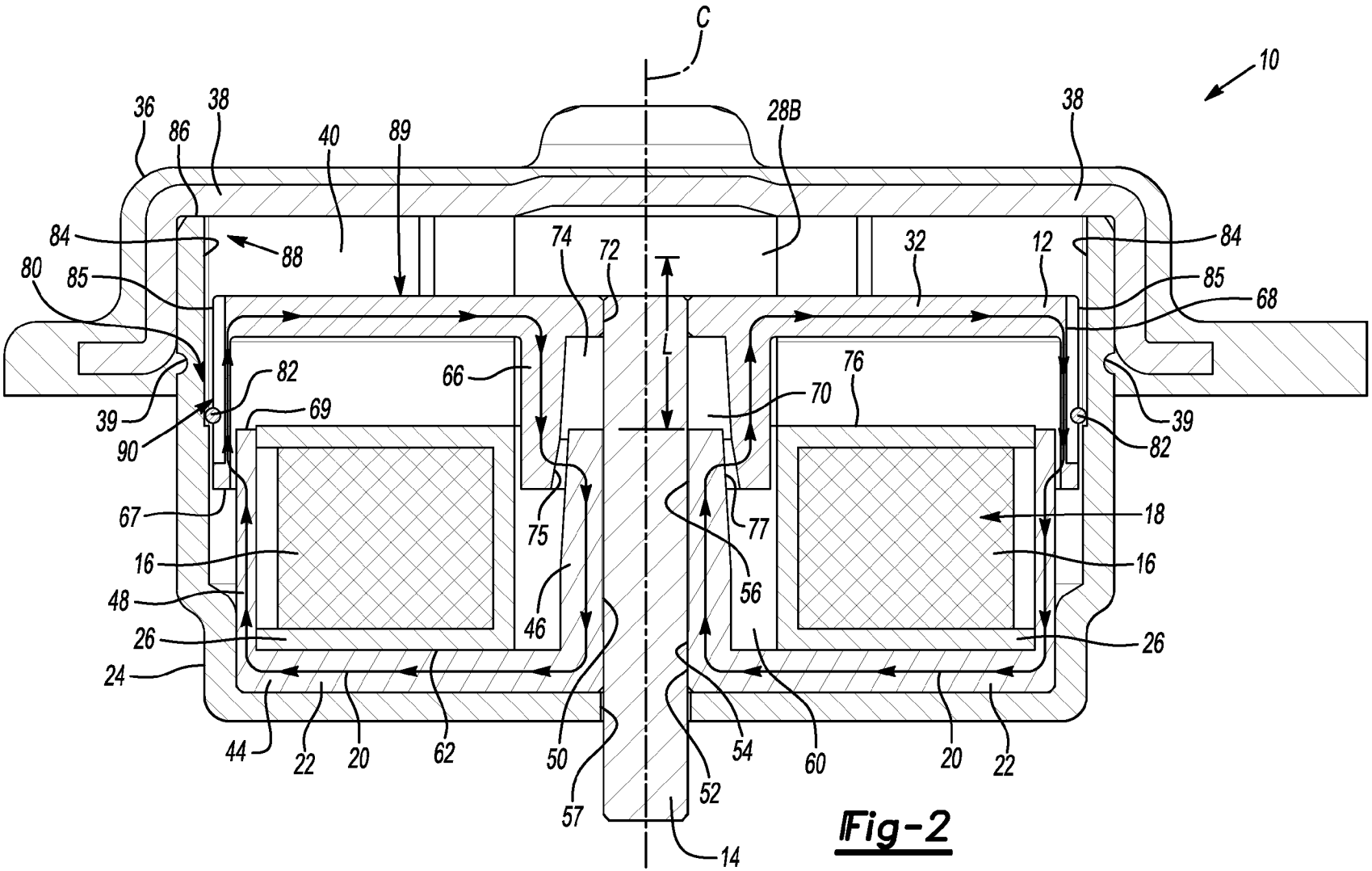
FIG. 2 is a schematic illustration in cross-sectional view of the solenoid assembly of FIG. 1 taken at lines 2-2 in FIG. 3.
Figure 6:
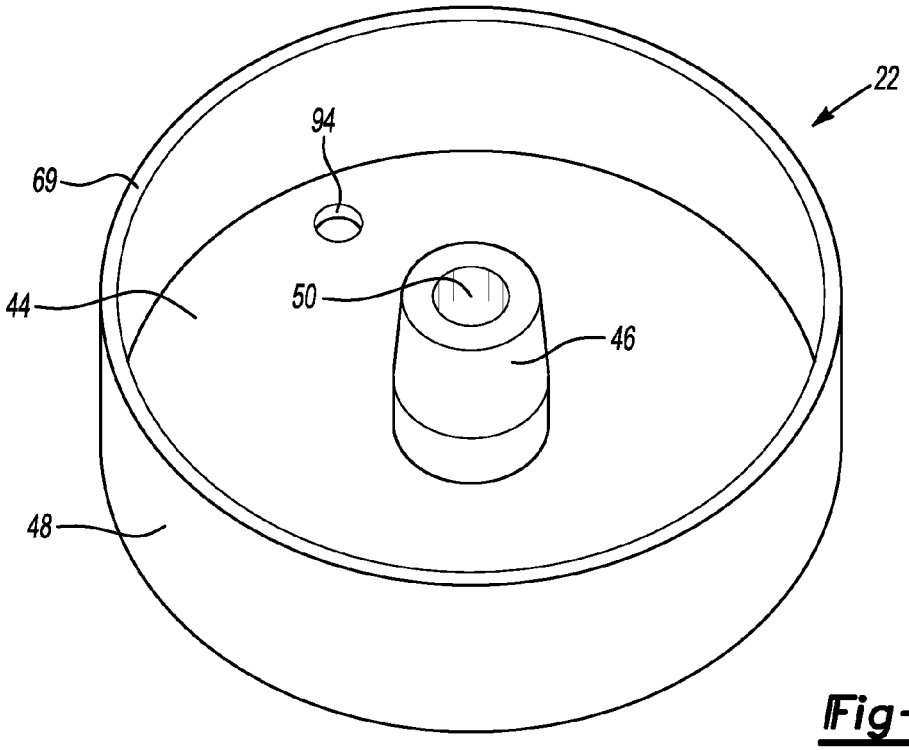
FIG. 6 is a schematic illustration in perspective view of a pole piece of the solenoid assembly of FIGS. 1-4.

FIG. 6 shows the pole piece 22 in perspective view. The pole piece 22 is a unitary, one-piece magnetic or magnetizable component that includes a base 44, referred to herein as a first base, with a first inner wall 46 that is generally cylindrical and a first outer wall 48 that is generally cylindrical both extending from one side of the base 44. The inner wall 46 defines a center opening 50. As shown in FIG. 2, the inner wall 46 is radially inward of the coil assembly 18 and extends through a center opening 60 of the coil assembly 18, also referred to as an inner opening. As used herein a radial direction, such as "radially inward" or "radially outward", is a direction perpendicular to a center axis C along which the pin 14 translates, and is a direction along radii of the generally cylindrical armature 12, coil assembly 18 and pole piece 22. The outer wall 48 is radially outward of the coil assembly 18 to radially surround the coil assembly 18. The pole piece 22 surrounds the coil assembly 18 from one side 62 (a lower side in FIG. 2, also referred to herein as a first side). The bobbin 26 rests on the base 44. The pole piece 22 and the coil assembly 18 do not move within the housing 24 due to the press-fit of the cap 38 and the overmolded portion 36 of the cap 38.

The pin 14 fits through the center opening 50 with sufficient clearance 52 to allow the pin 14 to move with the armature 12. The clearance 52 is controlled. As used herein, a clearance is "controlled" if it is machined or otherwise formed to maintain a predetermined tolerance. The clearance 52 is selected to minimize tilting of the pin 14 without creating resistance to movement of the pin 14. Because of an anti-rotation feature 80 discussed herein, the pin 14 and armature 12 are maintained to allow only linear movement of the pin along the center axis C of the pin 14. Accordingly, only a relatively small portion 54 of the inner wall 46 has a relatively tight, controlled clearance 52 with the pin 14. Another portion 56 of the inner wall 46 can create a larger clearance with the pin 14 without diminishing the linearity of movement of the pin 14. An aperture 57 in the solenoid housing 24 is larger than the opening at the small portion 54. The pin 14 extends through the aperture 57 to a greater or lesser extent as it translates along the center axis C. In this embodiment, the center axis C is also the center axis of the solenoid assembly 10.

Figure 7:
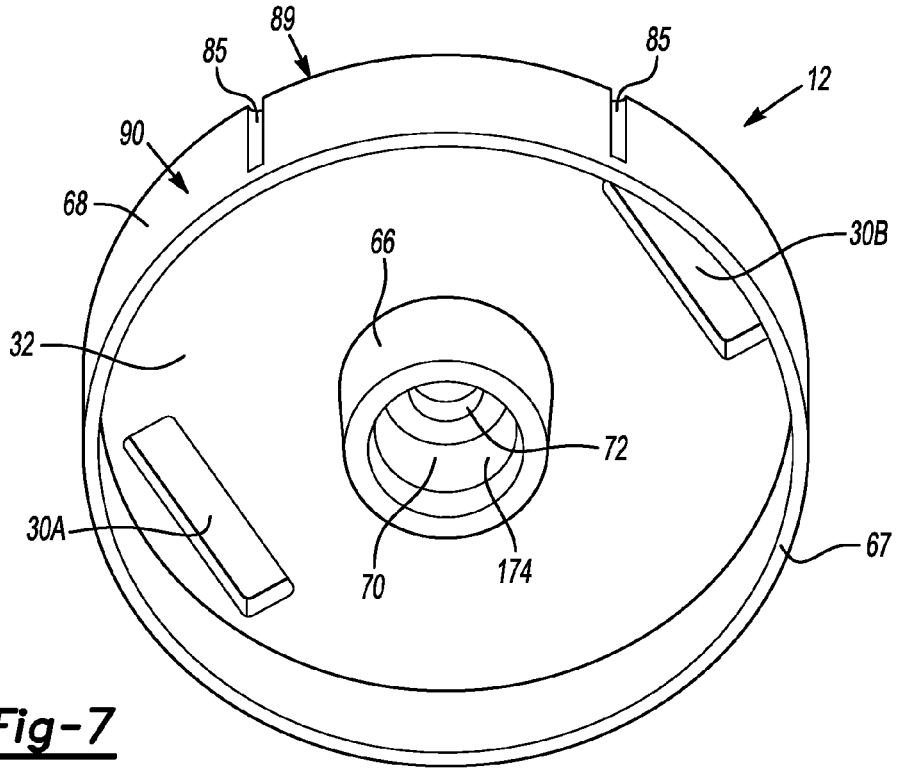
FIG. 7 is a schematic illustration in perspective view of an armature of the solenoid assembly of FIGS. 1-4.

FIG. 7 shows the armature 12 in perspective view. The armature 12 is a unitary, one-piece magnetic or magnetizable component that includes the base 32, referred to herein as a second base, with a second inner wall 66 that is generally cylindrical and a second outer wall 68 that is generally cylindrical. Both the inner wall 66 and the outer wall 68 extend from one side of the base 32. The inner wall 66 defines a stepped center opening 70. As shown in FIG. 2, the inner wall 66 is radially inward of the coil assembly 18 and extends through the center opening 60 of the coil assembly 18. The inner wall 66 is radially outward of the inner wall 46 of the pole piece 22. The outer wall 68 is radially outward of the coil assembly 18 to radially surround the coil assembly 18. The outer wall 68 is radially outward of the outer wall 48 of the pole piece 22 as well. The armature 12 surrounds the coil assembly 18 from one side 76 (an upper side in FIG. 2, also referred to herein as a second side).

When the coil 16 is energized, magnetic flux generated along the flux path 20 causes the armature 12 and pin 14 to move along a length of travel L from a position in which a rim 67 of the armature 12 is substantially aligned with a rim 69 of the pole piece 22 to a position in which the armature 12 contacts the bobbin 26. The armature 12 and pole piece 22 are coaxial with one another and with the coil assembly 18 about the center axis C. When the coil 16 is energized, the armature 12 moves along the length of travel L equal to a distance in the cavity 40 between the side 76 of the coil assembly 18 and an inner surface of the cap 38 less the thickness of the base 32, the cylindrical walls 66, 68 of the armature 12 overlap with the cylindrical walls 46, 48 of the pole piece 22 in a radial direction over substantially the entire length of travel L. The extent of travel of the pin 14 along the length of travel L is dependent upon the amount of electrical current provided to the solenoid assembly 10. When the armature 12 is at its most extreme position apart from the pole piece 22, that is, at the upper extreme of the cavity 40 in FIG. 2, if the rim 67 of the armature 12 is slightly higher than the rim 69 of the pole piece 22 so that the walls 66, 68 of the armature 12 do not overlap the walls 46, 48 of the pole piece 22 in a radial direction, the magnetic flux is sufficient to travel over an air gap between the pole piece 22 and the armature 12. The armature 12 can have a tapered surface 75 that travels adjacent to and over a tapered surface 77 of the pole piece 22. Tapered surfaces 75, 77 can increase the strength of the magnetic flux and thus the magnitude of the force translated to the pin 14. Tapered surfaces are especially useful for low profile solenoid assemblies such as solenoid assembly 10, allowing a relatively large force over a relatively long length of travel L.

The pin 14 is press-fit to the armature 12 at a first portion 72 of the stepped center opening 70. A second portion 74 of the stepped center opening 70 partially defines the inner wall 66 of the armature 12 and is radially outward of and partially surrounds the inner wall 46 of the pole piece 22.

The first and second openings 30A, 30B of the armature 12 shown in FIG. 7 are larger than the first and second posts 28A, 28B, respectively, to allow the armature 12 to travel along the length of travel L relative to the coil assembly 18 without contacting the posts 28A, 28B. Contact of the posts 28A, 28B with the armature 12 should be avoided because friction due to such contact can cause hysteresis in the flux path 20, decreasing the accuracy of the solenoid assembly 10. That is, the relationship between the amount of electrical current provided at the terminal 34 and the extent of movement of and force provided to move the pin 14 will be uncertain if undesirable hsytereses affect the flux path 20. If the posts 28A, 28B are a plastic material, repeated contact could cause wear, leading to even greater friction.

In order to maintain linear travel of the pin 14 without contact between the posts 28A, 28B and the armature 12, rotation of the armature 12 about the center axis C is minimized or eliminated. Without control of rotation, the armature 12 could turn sufficiently so that the posts 28A, 28B would contact the armature 12 at edges of the openings 30A, 30B. To substantially or completely eliminate rotation of the armature 12 and prevent any such contact, at least one anti-rotation feature 80 is provided in the solenoid assembly 10. Furthermore, locating features 94, 96, and 98 described herein are provided to ensure that the coil assembly 18 and posts 28A, 28B are oriented properly with respect to the armature 12 when assembled.

The anti-rotation feature 80 is a ball bearing that includes a ball 82 sized to ride within a track formed by a first elongated recess 84 and a second elongated recess 85. The recess 84 extends from a rim 86 of the housing 24 along an inner surface 88 of the housing 24. The recess 85 extends from the upper surface 89 of the base 32 of the armature 12 along an outer surface 90 of the outer wall 68. The ball 82 is trapped between the housing 24 and the armature 12 and can travel only linearly along the recesses 84, 85. The armature 12 can have material that is deformed over the recess 85 near the surface 89 so that balls 82 cannot exit from between the armature 12 and the housing 24 at the aligned recesses 84, 85 near the surface 89. The ball 82 is too large to fit between a clearance between the armature 12 and the housing 24, and so prevents any rotation of the armature 12. Although only one anti-rotation feature in the form of a single bearing would sufficiently prevent rotation, the solenoid assembly 10 has six substantially identical anti-rotation features 80 in the form of bearings spaced about the outer surface 90 of the armature 12. Six recesses 85 (three visible in FIG. 3) are provided in the armature 12 that are alignable with six recesses 84 in the housing 24 to support a ball 82 in each. With multiple anti-rotation features 80 in the form of bearings, the controlled clearance 52 can be provided along a shorter portion 54 of the interface between the pin 14 and the inner wall 46 of the pole piece 22. Because the controlled clearance 52 requires more labor intensive manufacturing, such as machining, reducing the extent of the controlled clearance 52 may present a cost savings. For example, in an embodiment with only one anti-rotation feature 80 in the form of a bearing as described, it may be desirable to provide the tighter clearance 52 along the entire inner surface of the opening 50 for smooth linear translation of the armature 12 and pin 14.

In order to properly orient the coil assembly 18 within the housing 24 so that the posts 28A, 28B will extend through the openings 30A, 30B, the pole piece 22, the housing 24 and the bobbin 26 are each provided with a respective locating feature. Specifically, the pole piece 22 has a relatively small hole 94 extending through the base 44. As shown in FIG. 1, the surface of the bobbin 26 that contacts the base 44 has a dimple 96 that is configured to fit within the hole 94. The dimple 96 can be a circular extension. Similarly, a surface of the housing 24 that contacts the pole piece 22 has a dimple 98 that fits within the hole 94. The dimple 98 can be a circular extension. When the coil assembly 18 is placed within the pole piece 22, the dimple 96 is aligned with and placed within the hole 94. When the pole piece 22 is placed within the housing 24, the dimple 98 is aligned with and placed within the hole 94. When the armature 12 and pin 14 are subsequently placed in the housing 24 with the recesses 85 aligned with the recesses 84 and the balls 82 in the aligned recesses 84, 85, the posts 28A, 28B will extend through the openings 30A, 30B. The locating features 94, 96, 98 thus place the posts 28A, 28B in a predetermined orientation in the housing 24 that coincides with the correct orientation of the armature 12 within the housing 24 so that the recesses 85 align with the recesses 84.

FIG. 3 shows that the post 28B has an extension 100 that is smaller in size than an extension 102 of post 28A. The extension 102 includes slots 104 for the terminals 33A, 33B to route to the coil 16 along the post 28A. The cap 38 with overmolded portion 36 has a slot 106 shown in FIG. 1 that is large enough to receive the extension 100 but too small to receive the extension 102. A larger slot 108 is provided in the cap 38 to receive the extension 102. Thus, when the cap 38 is placed on the posts 28A, 28B with the extensions 100, 102 received in the appropriate slots 106, 108, the terminals 33A, 33B will extend in the appropriate direction to be placed in a mold to apply the overmolded portion 36.

The solenoid assembly 10 is thus configured with at least one anti-rotation feature 80 to allow the overlapping armature 12 and pole piece 22 to be used, establishing a flux path 20 that travels only through the armature 12 and the pole piece 22. The coil assembly 18 is surrounded by the armature 12. Electrical terminals 33A, 33B extend along the post 28A to provide an electrical connection to the coil 16 through the armature 12. The anti-rotation feature 80 enhances the smoothness of linear travel of the armature 12, allowing a smaller portion of the interface between the pin 14 and the opening 50 to be a controlled clearance 52.

Figure 8:
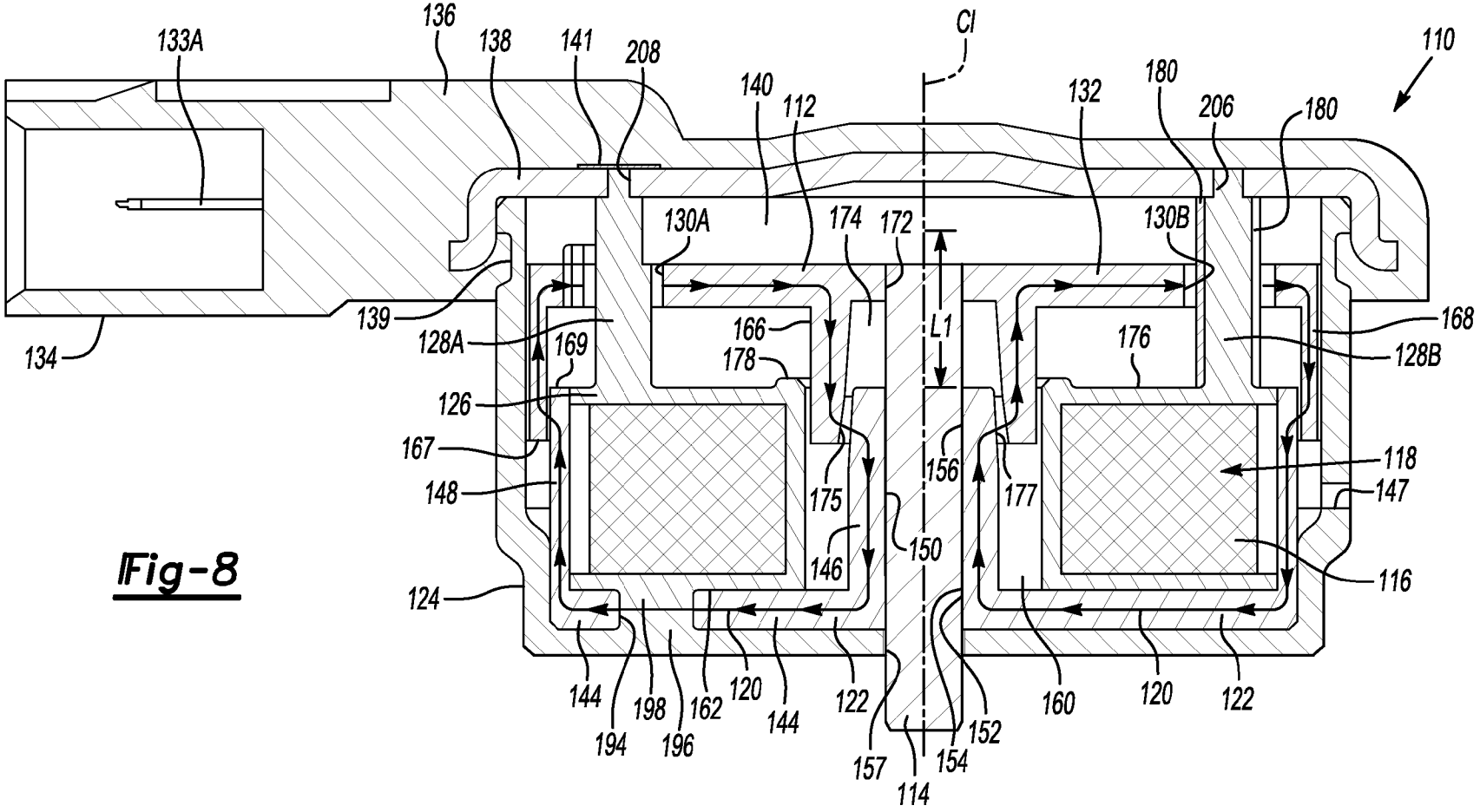
FIG. 8 is a schematic illustration in cross-sectional view of a solenoid assembly in another aspect of the present teachings, taken at lines 8-8 in FIG. 10.

FIG. 8 shows a solenoid assembly 110 in another aspect of the present teachings. The solenoid assembly 110 has a movable armature 112 that moves a pin 114. The pin 114 can be attached to a valve or other component such as to control fluid flow. The pin 114 may be moved with a variable force dependent on electrical current provided to a coil 116 of a coil assembly 118. The solenoid assembly 110 is configured so that a flux path 120 established by magnetic flux created when the coil 116 is energized travels only through the armature 112 and a pole piece 122. This reduces the number of components and simplifies the solenoid assembly 110 because flux collectors are not required, and because a solenoid housing 124 that contains the armature 112, the coil assembly 118, and the pole piece 122 does not need to be configured to form a portion of the flux path. As such, the solenoid housing 124 need not be magnetic or magnetizable, and so can be formed of a variety of nonmagnetic materials, such as an aluminum alloy or plastic. In FIG. 8, the flux path 120 travels through the armature 112 around posts 128A, 128B, and through the pole piece 122 around locating features 196, 198 of a bobbin 126 and the solenoid housing 124.

As best shown in FIG. 8, the coil assembly 118 includes the bobbin 126 around which the coil 116 is wound. The bobbin 126 includes integral first and second posts 128A, 128B that extend through first and second openings 130A, 130B in a base 132 of the armature 112. The base 132 is referred to herein as a second base. Electrical terminals 133A, 133B, best shown in FIG. 9, extend from an electrical connector 134 through an overmolded portion 136 of a cap 138 and along the first post 128A to the coil 116. The overmolded portion 136 flows into a recess 139 around the housing 124 to help retain the overmolded portion 136 to the housing 124. FIG. 10 shows the overmolded portion 136 forms the electrical connector 134 and has flanges 137 with fastener openings 142 that permit the solenoid assembly 110 to be mounted to a component that receives the pin 114. The solenoid assembly 110 can be mounted to a component, such as an engine, with fasteners extending through the fastener openings 142, so that a center axis C1 (shown in FIG. 8) of the solenoid assembly 110 is generally horizontal, allowing any oil that is wicked into the cavity 140 of the solenoid assembly 110 to drain out through a drain hole 147 formed in the solenoid housing 124. The solenoid assembly 110 would be mounted with the drain hole 147 at a lowest position. Although not shown in the cross-sectional view of FIG. 1, the solenoid assembly 10 also has a drain hole similar to drain hole 147, allowing oil to drain from the cavity 40 of the solenoid assembly 10.

Referring to FIG. 8, the cap 138 is press-fit to the posts 128A, 128B to retain the pole piece 122 against the housing 124 and cause the bobbin 126 to be press-fit against the pole piece 122. The cap 138 and the housing 124 together define a cavity 140 in which the pole piece 122, coil assembly 118 and armature 112 are located. Prior to overmolding the cap 138 and the electrical terminals 133A, 133B, an elastomeric pad 141 is placed against the top of the cap 138. Slits 143 in the elastomeric pad 141 (shown in FIG. 9) allow the terminals 133A, 133B to extend through the elastomeric pad 141. The terminals 133A, 133B can be placed through the slits 143 prior to bending the terminals 133A, 133B. The elastomeric pad 141 prevents any oil or other fluid in the cavity 140 from wicking along the electrical terminals 133A, 133B to the ends at the electrical connector 134. The elastomeric pad 141 also prevents plastic from entering the cavity 140 during overmolding of the cap 138.

Figure 12:
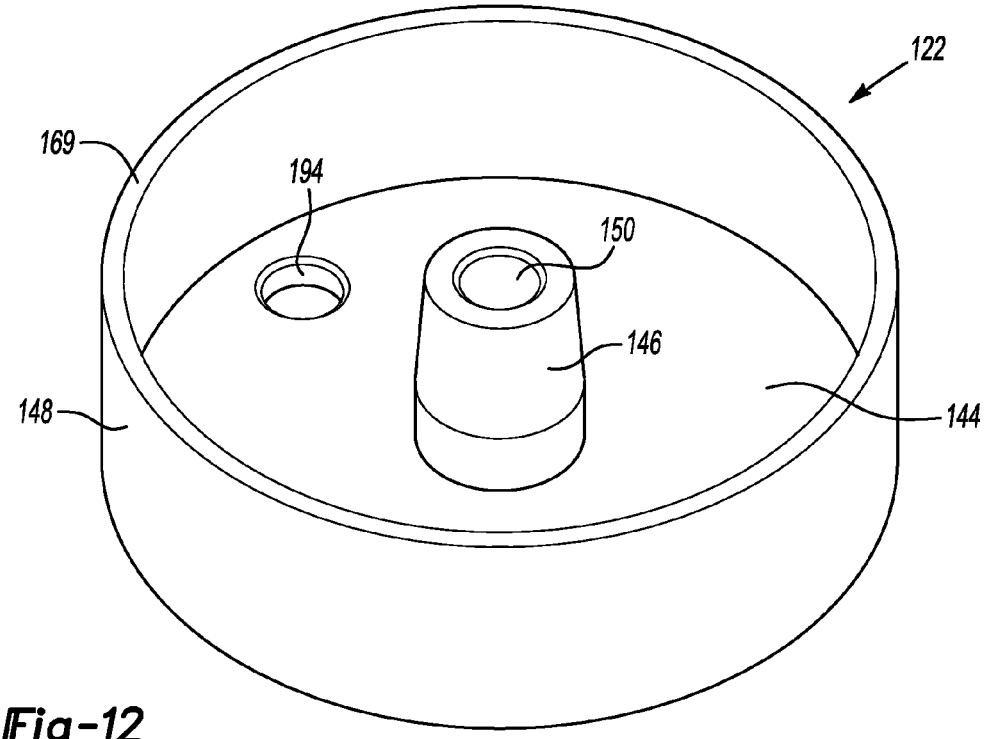
FIG. 12 is a schematic illustration in perspective view of a pole piece of the solenoid assembly of FIGS. 8-11.

FIG. 12 shows the pole piece 122 in perspective view. The pole piece 122 is a unitary, one-piece magnetic or magnetizable component that includes a base 144, referred to herein as a first base, with a first inner wall 146 that is generally cylindrical and a first outer wall 148 that is generally cylindrical, both extending from one side of the base 144. The inner wall 146 defines a center opening 150. As shown in FIG. 8, the inner wall 146 is radially inward of the coil assembly 118 and extends through a center opening 160 of the coil assembly 118, also referred to as an inner opening. As used herein a radial direction, such as "radially inward" or "radially outward", is a direction perpendicular to a center axis C1 along which the pin 114 translates, and is a direction along radii of the generally cylindrical armature 112, coil assembly 118 and pole piece 122. The outer wall 148 is radially outward of the coil assembly 118 to radially surround the coil assembly 118. The pole piece 122 surrounds the coil assembly 118 from one side 162 (a lower side in FIG. 8, referred to herein as a first side). The bobbin 126 rests on the base 144. The pole piece 122 and the coil assembly 118 do not move within the housing 124 due to the press-fit of the cap 138 and the overmolded portion 136 of the cap 138.

FIG. 8 shows that the pin 114 fits through the center opening 150 with sufficient clearance 152 to allow the pin 114 to move with the armature 112. The clearance 152 is controlled. As used herein, a clearance is "controlled" if it is machined or otherwise formed to maintain a predetermined tolerance. The clearance 152 is selected to minimize tilting of the pin 114 without creating resistance to movement of the pin 114. An aperture 157 in the solenoid housing 124 is larger than an opening at a relatively small portion 154 of the inner wall 146 that has the relatively tight controlled clearance. Another portion 156 of the inner wall 146 can create a larger clearance with the pin 114 without diminishing the linearity of movement of the pin 114. The pin 114 extends through the aperture 157 to a greater or lesser extent as it translates along the center axis C1. In this embodiment, the center axis C1 is also the center axis of the solenoid assembly 110.

Figure 13:
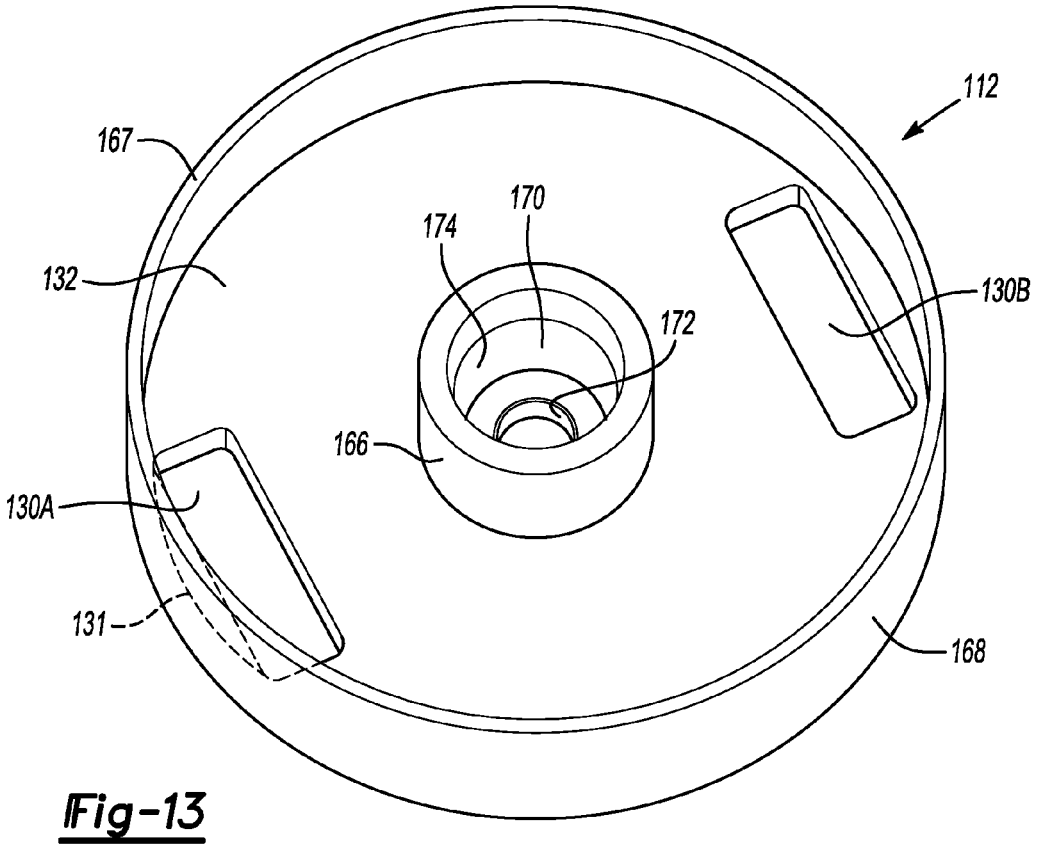
FIG. 13 is a schematic illustration in perspective view of an armature of the solenoid assembly of FIGS. 8-12.

FIG. 13 shows the armature 112 in perspective view with the armature 112 inverted from its position in FIG. 8. That is, in FIG. 13, the armature 112 is viewed partially from below. The armature 112 is a unitary, one-piece magnetic or magentizable component that includes the base 132, referred to herein as a second base, with a second inner wall 166 that is generally cylindrical and a second outer wall 168 that is generally cylindrical. Both the inner wall 166 and the outer wall 168 extend from one side of the base 132. The inner wall 166 defines a stepped center opening 170. As shown in FIG. 8, the inner wall 166 is radially inward of the coil assembly 118 and extends through the center opening 160 of the coil assembly 118. The inner wall 166 is radially outward of the inner wall 146 of the pole piece 122. The outer wall 168 is radially outward of the coil assembly 118 to radially surround the coil assembly 118. The outer wall 168 is radially outward of the outer wall 148 of the pole piece 122 as well. The armature 112 surrounds the coil assembly 118 from one side 176 (an upper side in FIG. 8, also referred to herein as a second side).

When the coil 116 is energized, magnetic flux generated along the flux path 120 causes the armature 112 and pin 114 to move along a length of travel L1, indicated in FIG. 8, from a position in which a rim 167 of the armature 112 is substantially aligned with a rim 169 of the pole piece 122 to a position in which the armature 112 contacts the bobbin 126 (i.e., rests on the upper side of the coil assembly 118 at an inner ridge 178 of the bobbin 126). The armature 112 and pole piece 122 are coaxial with one another and with the coil assembly 118 about the center axis C1. When the coil 116 is energized, the armature 112 moves along the length of travel L1 equal to a distance in the cavity 140 between the side 176 of the coil assembly 118 and an inner surface of the cap 138 less the thickness of the base 132. The cylindrical walls 166, 168 of the armature 112 overlap with the cylindrical walls 146, 148 of the pole piece 122 in a radial direction over substantially the entire length of travel L1. The extent of travel of the pin 114 along the length of travel L1 is dependent upon the amount of electrical current provided to the solenoid assembly 110. When the armature 112 is at its most extreme position apart from the pole piece 122, that is, at the upper extreme of the cavity 140 in FIG. 8, if the rim 167 of the armature 112 is slightly higher than the rim 169 of the pole piece 122 so that the walls 166, 168 of the armature 112 do not overlap the walls 146, 148 of the pole piece 122 in a radial direction, the magnetic flux is sufficient to travel over an air gap between the pole piece 122 and the armature 112. The armature 112 can have a tapered surface 175 that travels adjacent to and over a tapered surface 177 of the pole piece 122. Tapered surfaces 175, 177 can increase the strength of the magnetic flux and thus the magnitude of the force translated to the pin 114. Tapered surfaces are especially useful for low profile solenoid assemblies such as solenoid assembly 110, allowing a relatively large force over a relatively long length of travel L1.

The pin 114 is press-fit to the armature 112 at a first portion 172 of the stepped center opening 170. A second portion 174 of the stepped center opening 170 partially defines the inner wall 166 of the armature 112 and is radially outward of and partially surrounds the inner wall 146 of the pole piece 122.

The first and second openings 130A, 130B of the armature 112 shown in FIGS. 5, 8, 9 and 13 are larger than the first and second posts 128A, 128B, respectively, to allow the armature 112 to travel along the length of travel L1 relative to the coil assembly 118 without contacting the posts 128A, 128B. The opening 130A has a curved edge 131 generally following the curvature of the outer wall 168. The curved edge 131 ensures that the armature 112 will not contact the electrical terminals 133A, 133B that run along the side of the post 128A closest to the outer wall 168.

Figure 11:
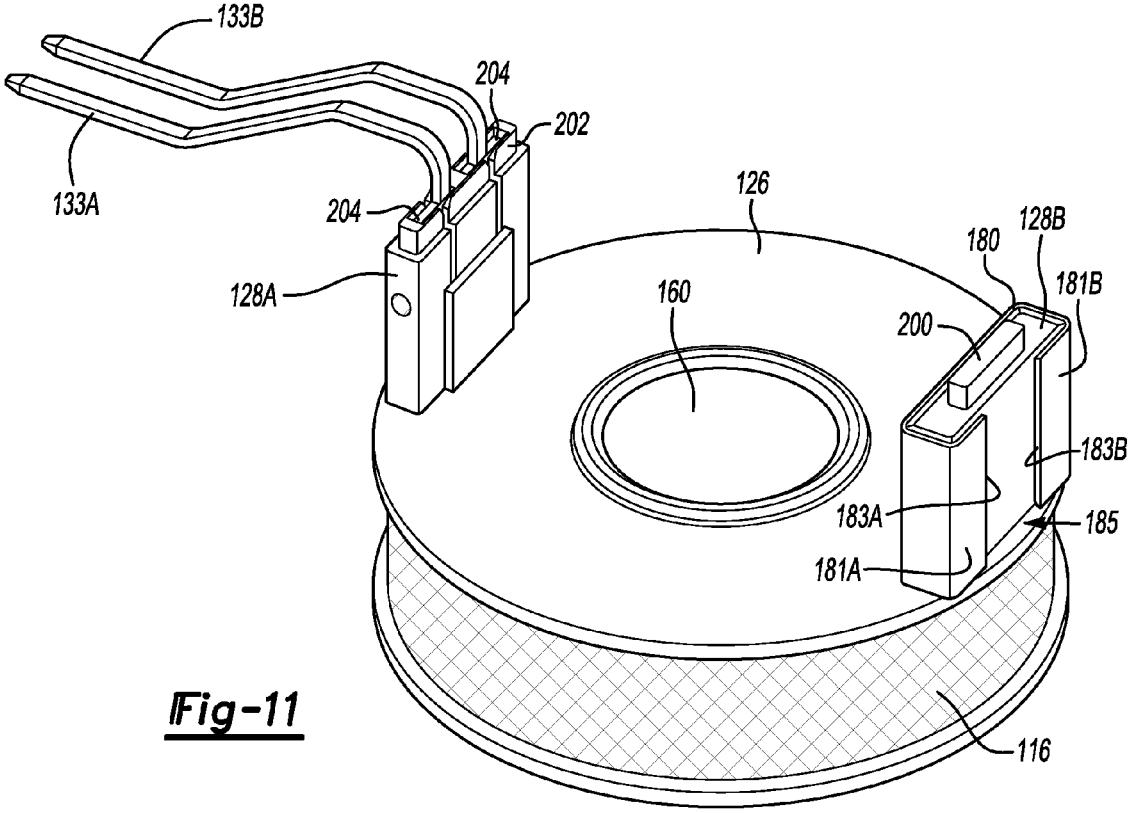
FIG. 11 is a schematic perspective illustration of a coil assembly included in the solenoid assembly of FIG. 8 with the cap, the overmolded portion, and a housing removed.

In order to maintain substantially linear travel of the pin 114 without contact between the posts 128A, 128B and the armature 112, a steel sleeve 180 is placed around the post 128B. As best shown in FIG. 11, the sleeve 180 has arms 181A, 181B with ends 183A, 183B that are biased inward. The arms 181A, 181B are bent approximately three to five degrees inward toward the remainder of the sleeve 180 so that the arms 181A, 181B are effectively spring-loaded inward to securely retain the sleeve 180 to the post 128B. The ends 183A, 183B are pulled outward when fitting the sleeve 180 around the post 128B. The sleeve 180 may slide downward over the post 128B. When the ends 181A, 181B are released, they bias the sleeve 180 against the post 128B. The arms 181A, 181B are configured so that a gap 185 remains between the arms 181A, 181B and the sleeve 180 does not entirely surround the post 128B.

The sleeve 180 can be steel or another material that has a relatively low coefficient of friction. Accordingly, when the armature 112 rotates slightly and touches the sleeve 180, the armature 112 will be able to easily slide along the sleeve 180 with very little friction as the armature 112 moves along the length of travel L1.

Figure 9:
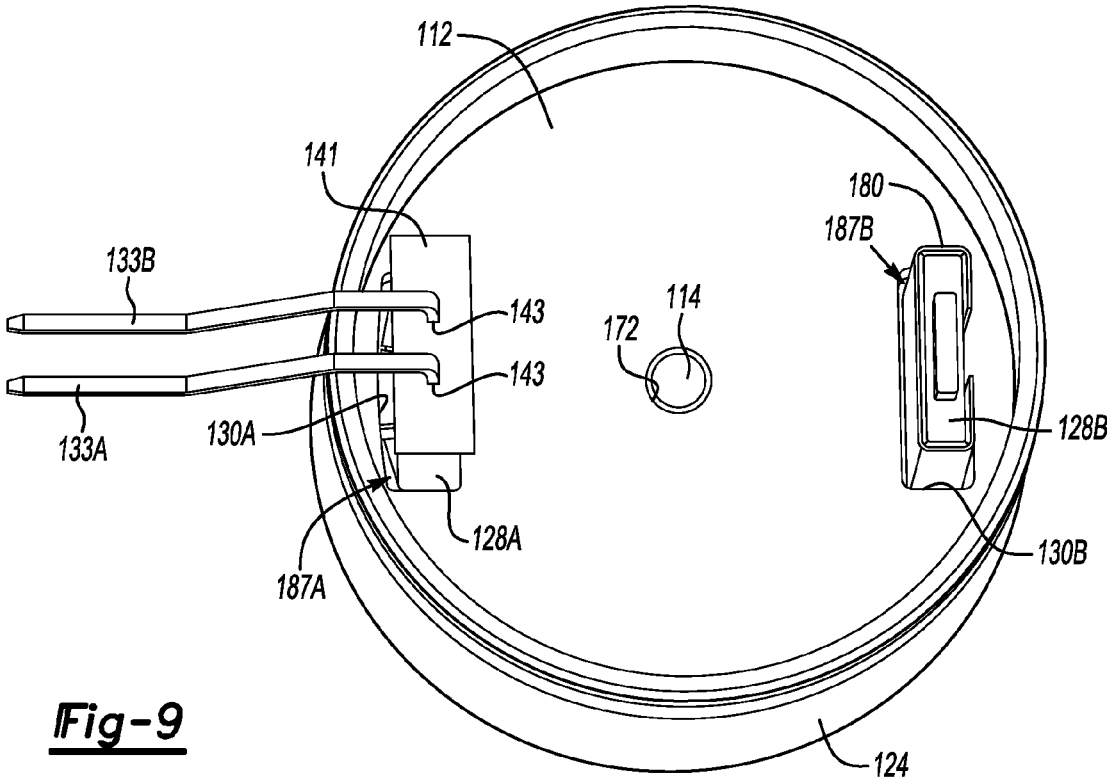
FIG. 9 is a schematic perspective illustration of the solenoid assembly of FIG. 8 with a cap and an overmolded portion removed.
Figure 10:
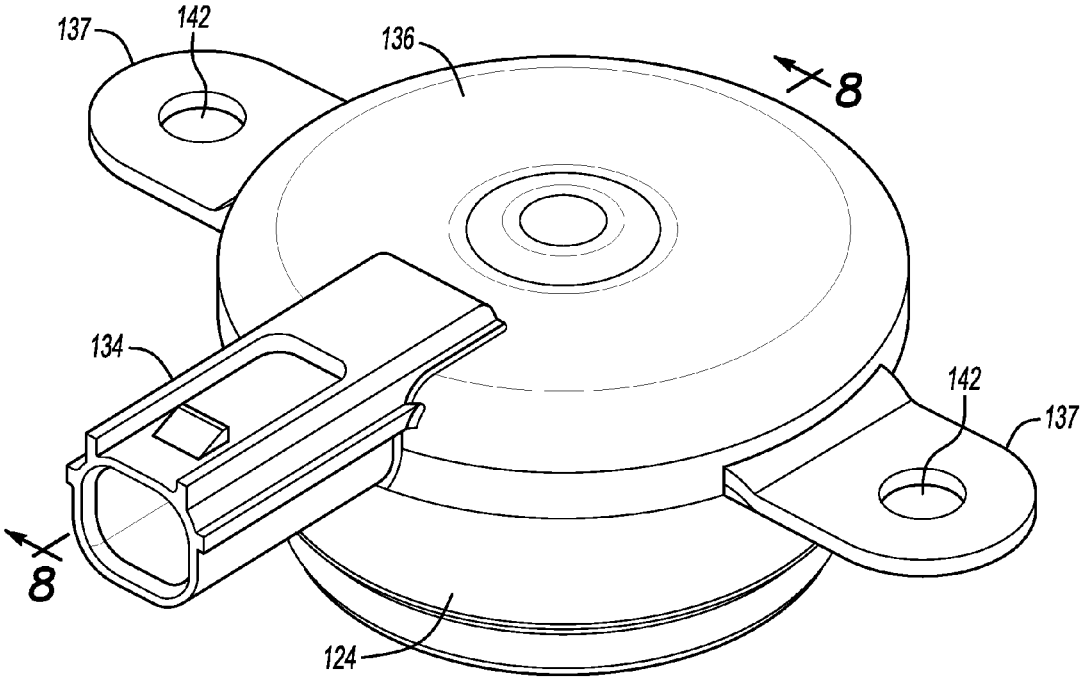
FIG. 10 is a schematic perspective illustration of the solenoid assembly of FIG. 8.

As indicated in FIG. 9, the first post 128A and the opening 130A are sized to define a first gap 187A between the post 128A and the armature 112 at the opening 130A. The second post 128B and the sleeve 180 thereon are sized so that a second gap 187B defined between the sleeve 180 and the armature 112 at the opening 130B is smaller than the first gap 187A. Rotation of the armature 112 will thus cause the armature 112 to contact the sleeve 180 with the sleeve 180 effectively stopping the rotation. No contact will occur between the armature 112 and the post 128A. In other aspects of the present teachings, the sleeve 180 may instead by placed around the first post 128A, or sleeves 180 can be placed around both of the posts 128A, 128B. A sleeve placed around the first post 128A would be configured so that it would not contact or cover the terminals 133A, 133B on the outboard side of the post 128A (i.e., on the side closest to the outer wall 168).

Furthermore, locating features are provided to ensure that the coil assembly 118 and posts 128A, 128B are oriented properly with respect to the armature 112 when assembled. In order to properly orient the coil assembly 118 within the housing 124 so that the posts 128A, 128B will extend through the openings 130A, 130B, the pole piece 122, the housing 124 and the bobbin 126 are each provided with a respective locating feature. Specifically, as shown in FIG. 8, the pole piece 122 has a relatively small hole 194 extending through the base 144. The surface of the bobbin 126 that contacts the base 144 has a dimple 196 that is configured to fit within the hole 194. The dimple 196 can be a circular extension. Similarly, a surface of the housing 124 that contacts the pole piece 122 has a dimple 198 that fits within the hole 194. The dimple 198 can be a circular extension. When the coil assembly 118 is placed within the pole piece 122, the dimple 196 is aligned with and placed within the hole 194. When the pole piece 122 is placed within the housing 124, the dimple 198 is aligned with and placed within the hole 194. When the armature 112 and pin 114 are subsequently placed in the housing 124, the posts 128A, 128B will extend through the openings 130A, 130B. The locating features 194, 196, 198 thus place the posts 128A, 128B in a predetermined orientation in the housing 124.

FIG. 11 shows that the post 128B has an extension 200 that is smaller (lengthwise) in size than an extension 202 of post 128A. The extension 202 includes slots 204 for the terminals 133A, 133B to route to the coil 116 along the post 128A. The cap 138 with overmolded portion 136 has a slot 206 shown in FIG. 8 that is large enough to receive the extension 200 but too small to receive the extension 202. A larger slot 208 is provided in the cap 138 to receive the extension 202. Thus, when the cap 138 is placed on the posts 128A, 128B with the extensions 200, 202 received in the appropriate slots 206, 208, the terminals 133A, 133B will extend in the appropriate direction to be placed in a mold to apply the overmolded portion 136.

The solenoid assembly 110 is thus configured with at least one feature, i.e., the sleeve 180, to allow the overlapping armature 112 and pole piece 122 to be used, establishing a flux path 120 that travels only through the armature 112 and the pole piece 122, with the coil assembly 118 being surrounded by the armature 112 and the posts 128A, 128B, with electrical terminals 133A, 133B extending along the post 128A to provide an electrical connection to the coil 116 through the armature 112. The sleeve 180 also enhances the smoothness of linear travel of the armature 112, allowing a smaller portion of the interface between the pin 114 and the opening 150 to be a controlled clearance 152.

Figure 14:
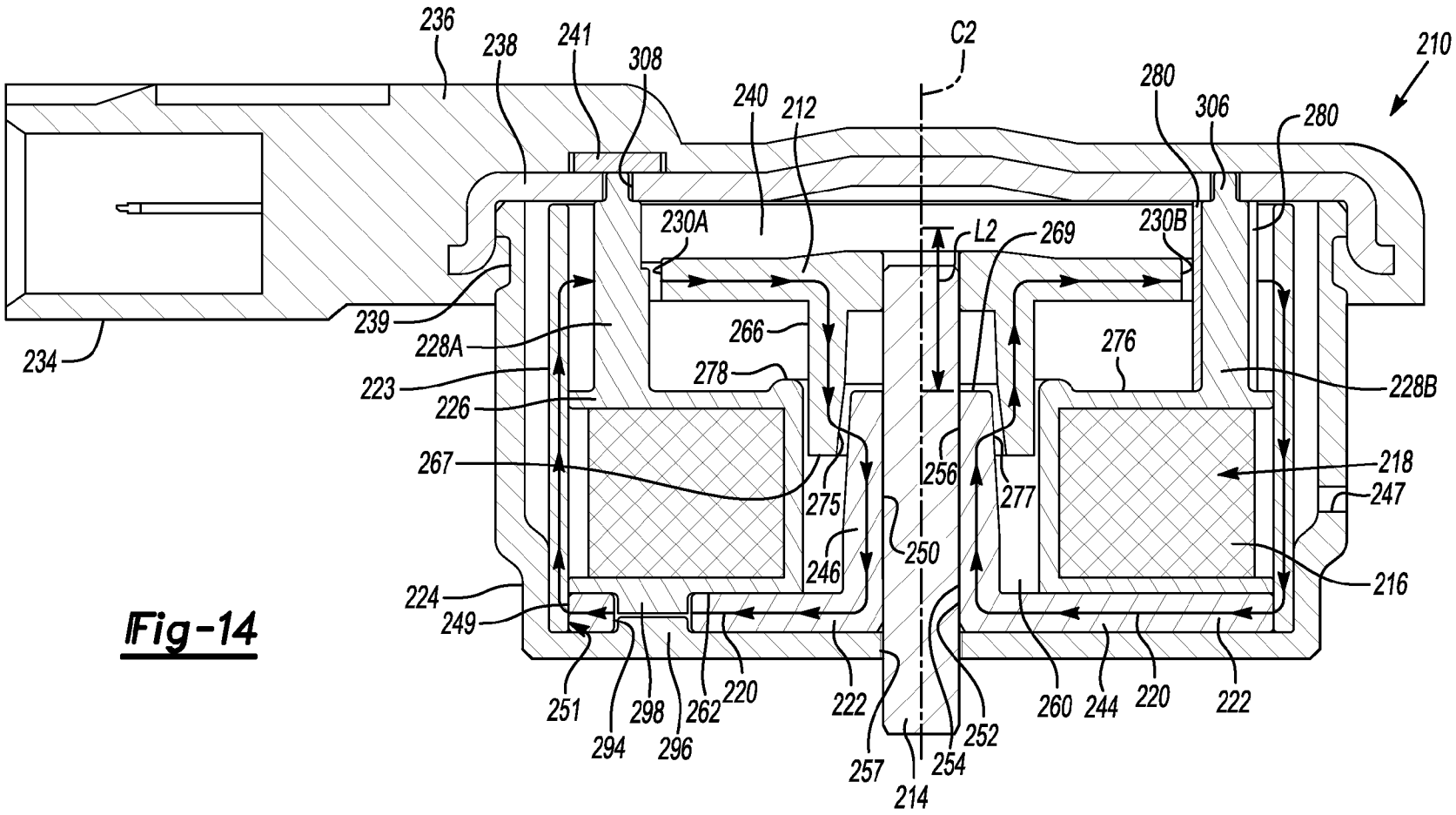
FIG. 14 is a schematic illustration in cross-sectional view of a solenoid assembly in another aspect of the present teachings, taken at lines 14-14 in FIG. 15.

FIG. 14 shows a solenoid assembly 210 in another aspect of the present teachings. As described herein, the solenoid assembly 210 uses an annular tubular member 223, shown best in FIG. 18, to form a portion of a flux path 220 in order to allow an armature 212 and a pole piece 222 to have a simpler configuration that is easier to manufacture. The solenoid assembly 210 has a movable armature 212 that moves a pin 214 press-fit to the armature 214. The pin 214 can be attached to a valve or other component such as to control fluid flow. The pin 214 may be moved with a variable force dependent on electrical current provided to a coil 216 of a coil assembly 218. The solenoid assembly 210 is configured so that a flux path 220 established by magnetic flux created when the coil 216 is energized travels through the armature 212, through a pole piece 222, and through the annular tubular member 223 that is press-fit to the pole piece 222 as described herein. This reduces the number of components and simplifies the solenoid assembly 210 because flux collectors are not required, and because a solenoid housing 224 that contains the armature 212, the coil assembly 218 and the pole piece 222 does not need to be configured to form a portion of the flux path. As such, the solenoid housing 224 need not be magnetic or magnetizable, and so can be formed of a variety of nonmagnetic materials, such as an aluminum alloy or plastic. In FIG. 12, the flux path 220 travels through the armature 212, around posts 228A, 228B, through the tubular member 223, and around locating features 296, 298 of a bobbin 226 and the solenoid housing 224. The tubular member 223 can be powdered metal or another suitable magnetic or magnetizable material.

Figure 17:
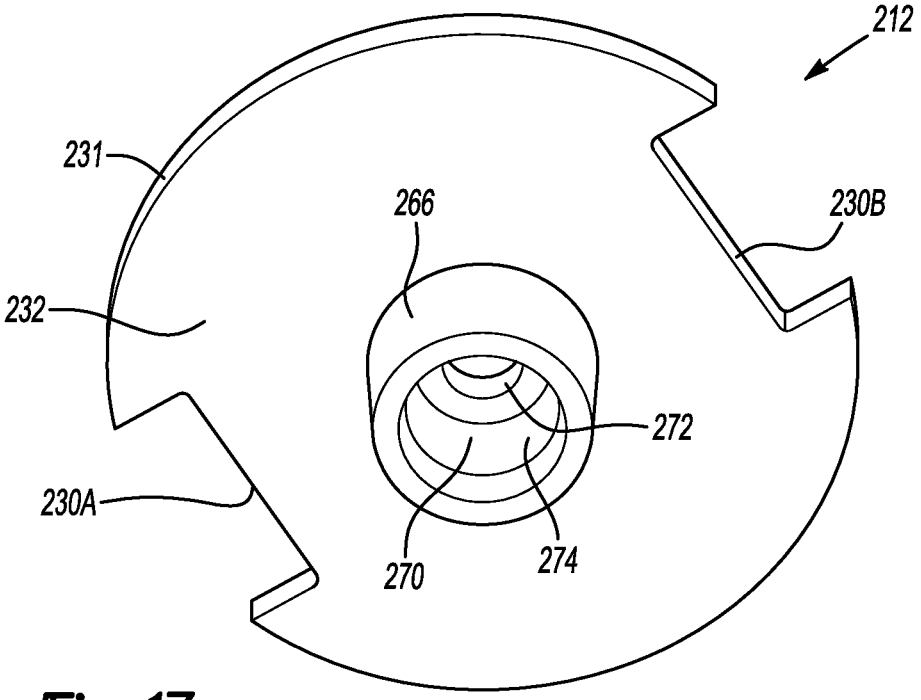
FIG. 17 is a schematic illustration in perspective view of an armature of the solenoid assembly of FIG. 14.

As best shown in FIG. 14, the coil assembly 218 includes the bobbin 226 around which the coil 216 is wound. The bobbin 226 includes integral first and second posts 228A, 228B that extend through first and second openings 230A, 230B in a base 232 of the armature 212. FIG. 17 shows that the openings 230A, 230B are three-sided and form part of a periphery 231 of the armature 212. Electrical terminals 233A, 233B, best shown in FIG. 15, extend from an electrical connector 234, shown in FIG. 14, through an overmolded portion 236 of a cap 238 and along the first post 228A to the coil 216. The overmolded portion 236 flows into a recess 239 around the housing 224 to help retain the overmolded portion 236 to the housing 224. Although not visible in the cross-section of FIG. 14, the overmolded portion 236 is configured like the overmolded portion 136 of FIG. 10, forming the electrical connector 234 and having flanges with fastener openings, like flanges 137 with fastener openings 142 shown in FIG. 10, that permit the solenoid assembly 210 to be mounted to a component that receives the pin 214. The solenoid assembly 210 can be mounted to a component, such as an engine, with fasteners extending through the fastener openings, so that a center axis C2 of the pin 214 (and the solenoid assembly 210) is generally horizontal, allowing any oil that is wicked into a cavity 240 of the solenoid assembly 210 to drain out through a drain hole 247 formed in the solenoid housing 224.

Referring to FIG. 14, the cap 238 is press-fit to the posts 228A, 228B to retain the pole piece 222 against the housing 224 and to cause the bobbin 226 to be press-fit against the pole piece 222. The cap 238 and the housing 224 together define a cavity 240 in which the pole piece 222, coil assembly 218 and armature 212 are located. Prior to overmolding the cap 238 and the electrical terminals 233A, 233B, an elastomeric pad 241 is placed against the top of the cap 238. Although not shown in the cross-sectional view of FIG. 14, like the pad 141 of FIG. 9, the pad 241 has slits allow the terminals 233A, 233B of FIG. 15 to extend through the elastomeric pad 241. The terminals 233A, 233B can be placed through the slits prior to bending the terminals 233A, 233B. The elastomeric pad 241 is removed in the view of FIG. 15. The elastomeric pad 241 substantially prevents any oil or other fluid in the cavity 240 from wicking along the electrical terminals 233A, 233B to the ends at the electrical connector 234. The elastomeric pad 241 also prevents plastic from entering the cavity 240 during overmolding of the cap 238.

Figure 16:
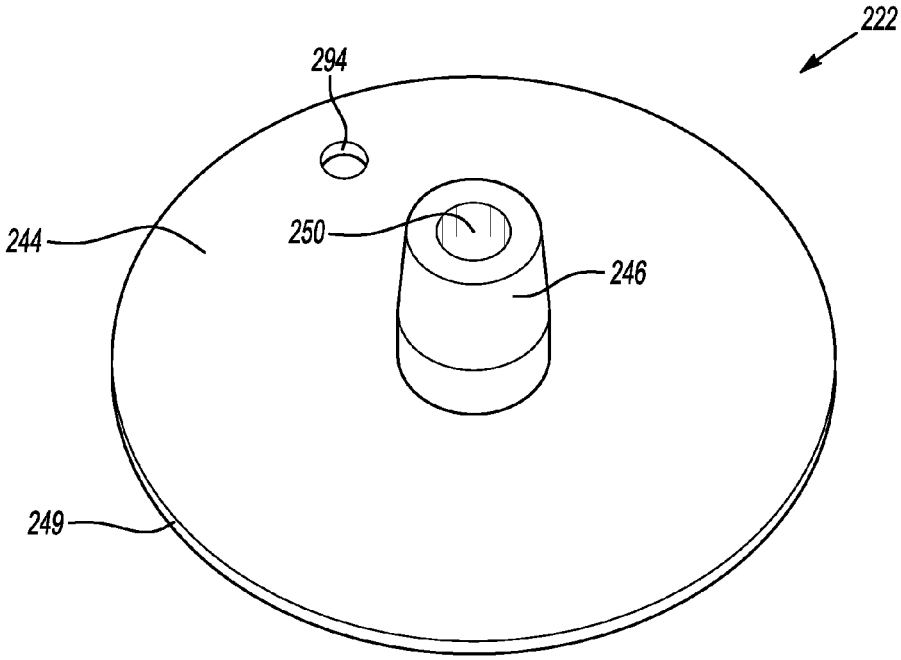
FIG. 16 is a schematic illustration in perspective view of a pole piece of the solenoid assembly of FIG. 14.
Figure 18:
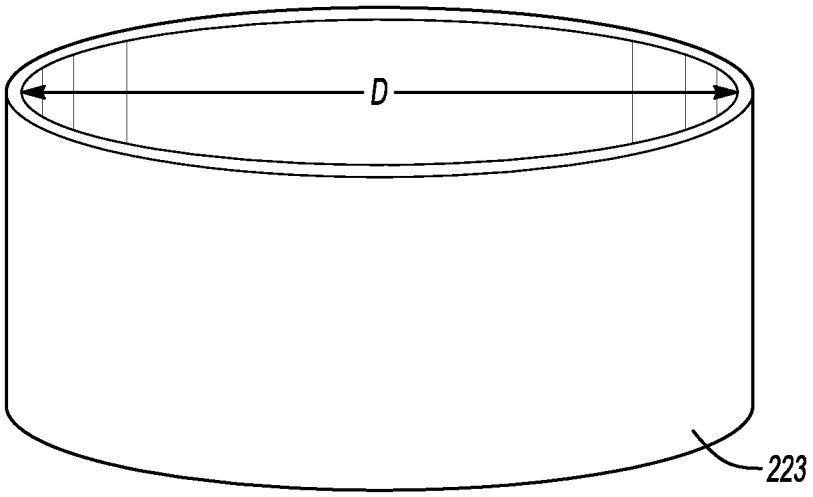
FIG. 18 is a schematic illustration in perspective view of a tubular member of the solenoid assembly of FIG. 14.

FIG. 16 shows the pole piece 222 in perspective view. The pole piece 222 is a unitary, one-piece magnetic or magnetizable component that includes a base 244, referred to herein as a first base, with a first inner wall 246 that is generally cylindrical extending from one side of the base 144. Unlike the pole pieces 22 and 122 of FIGS. 6 and 12, the pole piece 222 does not have an outer wall at its outer periphery. This makes the pole piece 222 simpler in design, and easier to manufacture. The pole piece 222 can be powdered metal or another suitable material. In lieu of an outer wall of the pole piece 222, the tubular member 223 is press-fit to a periphery 249 of the pole piece 222 and thereby forms a portion of the flux path as shown in FIG. 14. That is, an inner diameter D of the tubular member 223 in FIG. 18 is sized so that an inner surface 251 of the tubular member 223 is pressed against the periphery 249 of the pole piece 244 when the tubular member 226 is assembled to the pole piece 222 sufficiently to prevent relative movement of the tubular member 223 and the pole piece 222. The armature 212 has a slightly smaller radius so that the periphery 231 of the armature 212 is inward of the tubular member 223 when the tubular member 223 is press-fit to the pole piece 222. Stated differently, there is a clearance between the armature 212 and the tubular member 223 sufficient to allow the armature 212 to move in accordance with the magnetic flux along flux path 220 without contacting with the tubular member 223.

The inner wall 246 of the pole piece 222 defines a center opening 250. As shown in FIG. 14, the inner wall 246 is radially inward of the coil assembly 218 and extends through a center opening 260 of the coil assembly 218, also referred to as an inner opening. As used herein, a radial direction, such as "radially inward" or "radially outward", is a direction perpendicular to the center axis C2 along which the pin 214 translates, and is a direction along radii of the armature 212, coil assembly 218 and pole piece 222. The tubular member 223 is radially outward of the coil assembly 218 to radially surround the coil assembly 218. The pole piece 222 surrounds the coil assembly 218 from one side 262 (a lower side in FIG. 14, referred to herein as a first side). The bobbin 226 rests on the base 244. The pole piece 222 and the coil assembly 218 do not move within the housing 224 due to the press-fit of the cap 238 and the overmolded portion 236 of the cap 238.

The pin 214 fits through the center opening 250 with sufficient clearance 252 to allow the pin 214 to move with the armature 212. The clearance 152 is controlled. The clearance 152 is selected to minimize tilting of the pin 214 without creating resistance to movement of the pin 214. An aperture 257 in the solenoid housing 224 is larger than an opening at a relatively small portion 254 of the inner wall 246 that has the relatively tight controlled clearance. Another portion 256 of the inner wall 246 can create a larger clearance with the pin 214 without diminishing the linearity of movement of the pin 214. The pin 214 extends through the aperture 257 to a greater or lesser extent as it translates along the center axis C2. In this embodiment, the center axis C2 is also the center axis of the solenoid assembly 210.

FIG. 17 shows the armature 212 in perspective view with the armature 212 viewed partially from below. The armature 212 is a unitary, one-piece magnetic or magnetizable component that includes the base 232, referred to herein as a second base, with a second inner wall 266 that is generally cylindrical. The armature 212 can be powdered metal or another suitable material. The inner wall 266 extends from one side of the base 232. The inner wall 266 defines a stepped center opening 270. As shown in FIG. 14, the inner wall 266 is radially inward of the coil assembly 218 and extends through the center opening 260 of the coil assembly 218. The inner wall 266 is radially outward of the inner wall 246 of the pole piece 222. The armature 212 surrounds the coil assembly 218 from one side 276 (an upper side in FIG. 14, also referred to herein as a second side).

When the coil 216 is energized, magnetic flux generated along the flux path 220 causes the armature 212 and pin 214 to move along a length of travel L2, indicated in FIG. 14, from a position in which a rim 267 of the armature 212 is substantially aligned with a rim 269 of the pole piece 222 to a position in which the armature 212 contacts the bobbin 226 (i.e., rests on the upper side 276 of the coil assembly 218 at an inner ridge 278 of the bobbin 226). The armature 212 and pole piece 222 are coaxial with one another and with the coil assembly 218 about the center axis C2. When the coil 216 is energized, the armature 212 moves along the length of travel L2 equal to a distance in the cavity 240 between the side 276 of the coil assembly 218 and an inner surface of the cap 238 less the thickness of the base 232. The cylindrical wall 266 of the armature 212 overlaps with the cylindrical wall 246 of the pole piece 222 in a radial direction over substantially the entire length of travel L2. The extent of travel of the pin 214 along the length of travel L2 is dependent upon the amount of electrical current provided to the solenoid assembly 210. When the armature 212 is at its most extreme position apart from the pole piece 222, that is, at the upper extreme of the cavity 240 in FIG. 14, the magnetic flux is sufficient to travel over an air gap between the pole piece 222 and the armature 212 and over the clearance between the periphery 231 of the armature 212 (shown in FIG. 17) and the tubular member 223. The armature 212 can have a tapered surface 275 that travels adjacent to and over a tapered surface 277 of the pole piece 222. Tapered surfaces 275, 277 can increase the strength of the magnetic flux and thus the magnitude of the force translated to the pin 214. Tapered surfaces are especially useful for low profile solenoid assemblies such as solenoid assembly 210, allowing a relatively large force over a relatively long length of travel L2.

The pin 214 is press-fit to the armature 212 at a first portion 272 of the stepped center opening 270 shown in FIG. 17. A second portion 274 of the stepped center opening 270 partially defines the inner wall 266 of the armature 212 and is radially outward of and partially surrounds the inner wall 246 of the pole piece 222 shown in FIG. 14.

Figure 15:
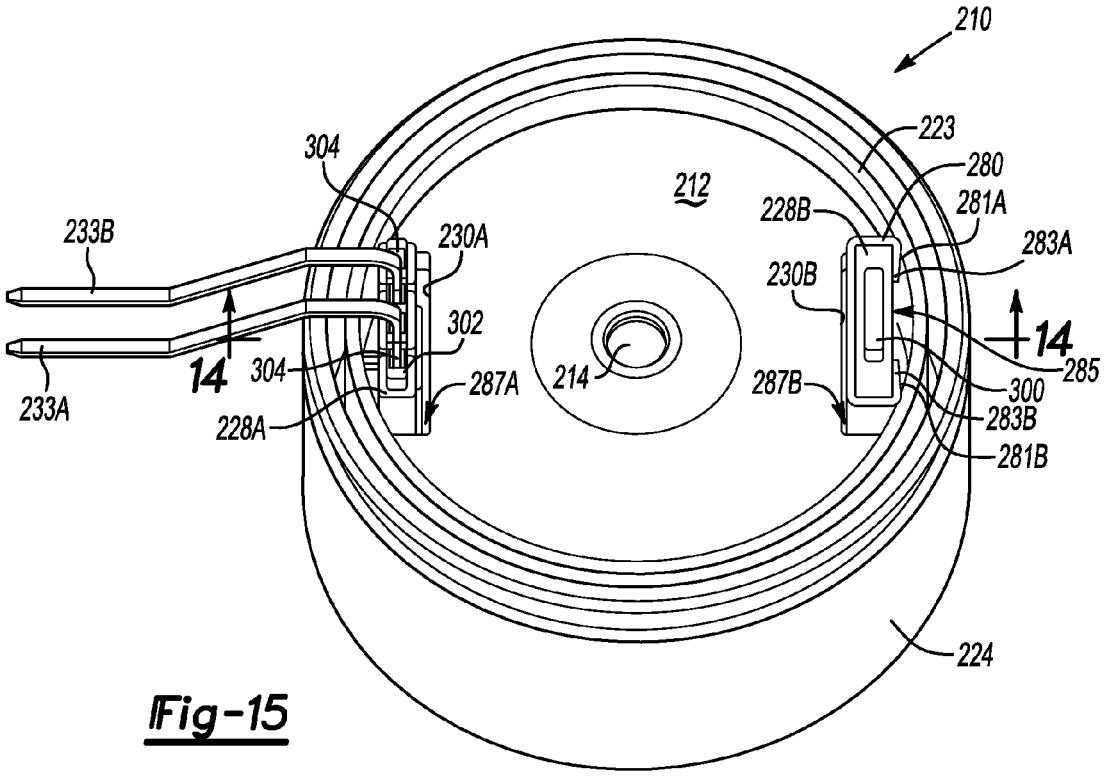
FIG. 15 is a schematic perspective illustration of the solenoid assembly of FIG. 14 with a cap, and an overmolded portion removed.

The first and second openings 230A, 230B of the armature 212 shown in FIGS. 14, 15 and 17 are larger than the first and second posts 228A, 228B, respectively, to allow the armature 212 to travel along the length of travel L2 relative to the coil assembly 218 without contacting the posts 228A, 228B. The openings 230A and 230B are slots in the armature 212 that define a portion of the periphery 231 of the armature 212. Because the armature 212 does not have an outer wall like outer wall 68 or 168 of FIGS. 7 and 13, and because the openings 230A, 230B are slots rather than holes, the armature 212 has a relatively simple shape and therefore may be less expensive to manufacture.

In order to maintain substantially linear travel of the pin 214 without contact between the posts 228A, 228B and the armature 212, a steel sleeve 280 is placed around the post 228B. As best shown in FIG. 15, the sleeve 280 has arms 281A, 281B with ends 283A, 283B that are biased inward. The arms 281A, 281B are bent approximately three to five degrees inward toward the remainder of the sleeve 280 so that the arms 281A, 281B are effectively spring-loaded inward to securely retain the sleeve 280 to the post 228B. The ends 283A, 283B are pulled outward when fitting the sleeve 280 around the post 228B. The sleeve 280 may slide downward over the post 228B. When the ends 281A, 281B are released, they bias the sleeve 280 against the post 228B. The arms 281A, 281B are configured so that a gap 285 remains between the arms 281A, 281B and the sleeve 280 does not entirely surround the post 228B.

The sleeve 280 can be steel or another material that has a relatively low coefficient of friction. Accordingly, when the armature 212 rotates slightly and touches the sleeve 280, the armature 212 will be able to easily slide along the sleeve 280 with very little friction as the armature 212 moves along the length of travel L2.

As indicated in FIG. 15, the first post 228A and the opening 230A are sized to define a first gap 287A between the post 228A and the armature 212 at the opening 230A. The second post 228B and the sleeve 280 thereon are sized so that a second gap 287B defined between the sleeve 280 and the armature 212 at the opening 230B is smaller than the first gap 287A. Rotation of the armature 212 will thus cause the armature 212 to contact the sleeve 280 with the sleeve 280 effectively stopping the rotation. No contact will occur between the armature 212 and the post 228A. In other aspects of the present teachings, the sleeve 280 may instead by placed around the first post 228A, or sleeves 280 can be placed around both of the posts 228A, 228B. A sleeve placed around the first post 228A would be configured so that it would not contact or cover the terminals 233A, 233B on the outboard side of the post 228A (i.e., on the side closest to the tubular member 223). In FIG. 15, the elastomeric pad 241 of FIG. 14 is removed.

Furthermore, locating features are provided to ensure that the coil assembly 218 and posts 228A, 228B are oriented properly with respect to the armature 212 when assembled. In order to properly orient the coil assembly 218 within the housing 224 so that the posts 228A, 228B will extend through the openings 230A, 230B, the pole piece 222, the housing 224 and the bobbin 226 are each provided with a respective locating feature. Specifically, as shown in FIG. 14, the pole piece 222 has a relatively small hole 294 extending through the base 244. The surface of the bobbin 226 that contacts the base 244 has a dimple 296 that is configured to fit within the hole 294. The dimple 296 can be a circular extension. Similarly, a surface of the housing 224 that contacts the pole piece 222 has a dimple 298 that fits within the hole 294. The dimple 298 can be a circular extension. When the coil assembly 218 is placed within the pole piece 222, the dimple 296 is aligned with and placed within the hole 294. When the pole piece 222 is placed within the housing 224, the dimple 298 is aligned with and placed within the hole 294. When the armature 212 and pin 214 are subsequently placed in the housing 224, the posts 228A, 228B will extend through the openings 230A, 230B. The locating features 294, 296, 298 thus place the posts 228A, 228B in a predetermined orientation in the housing 224.

FIG. 15 shows that the post 528B has an extension 300 that is smaller in size (lengthwise) than an extension 302 of post 228A. The extension 302 includes slots 304 for the terminals 233A, 233B to route to the coil 216 along the post 228A. The cap 238 with overmolded portion 236 has a slot 306 shown in FIG. 14 that is large enough to receive the extension 300 but too small to receive the extension 302. A larger slot 308 is provided in the cap 238 to receive the extension 302. Thus, when the cap 238 is placed on the posts 228A, 228B with the extensions 300, 302 received in the appropriate slots 306, 308, the terminals 233A, 233B will extend in the appropriate direction to be placed in a mold to apply the overmolded portion 236.

The solenoid assembly 210 is thus configured with at least one feature, i.e., the sleeve 280, to allow the posts 228A, 228B, with electrical terminals 233A, 233B extending along the post 228A to provide an electrical connection to the coil

216 through the armature 212 without contact of the armature 212 on the posts 228A, 228B. The sleeve 280 also enhances the smoothness of linear travel of the armature 212, allowing a smaller portion of the interface between the pin 214 and the opening 250 to be a controlled clearance 252.

Figure 19:
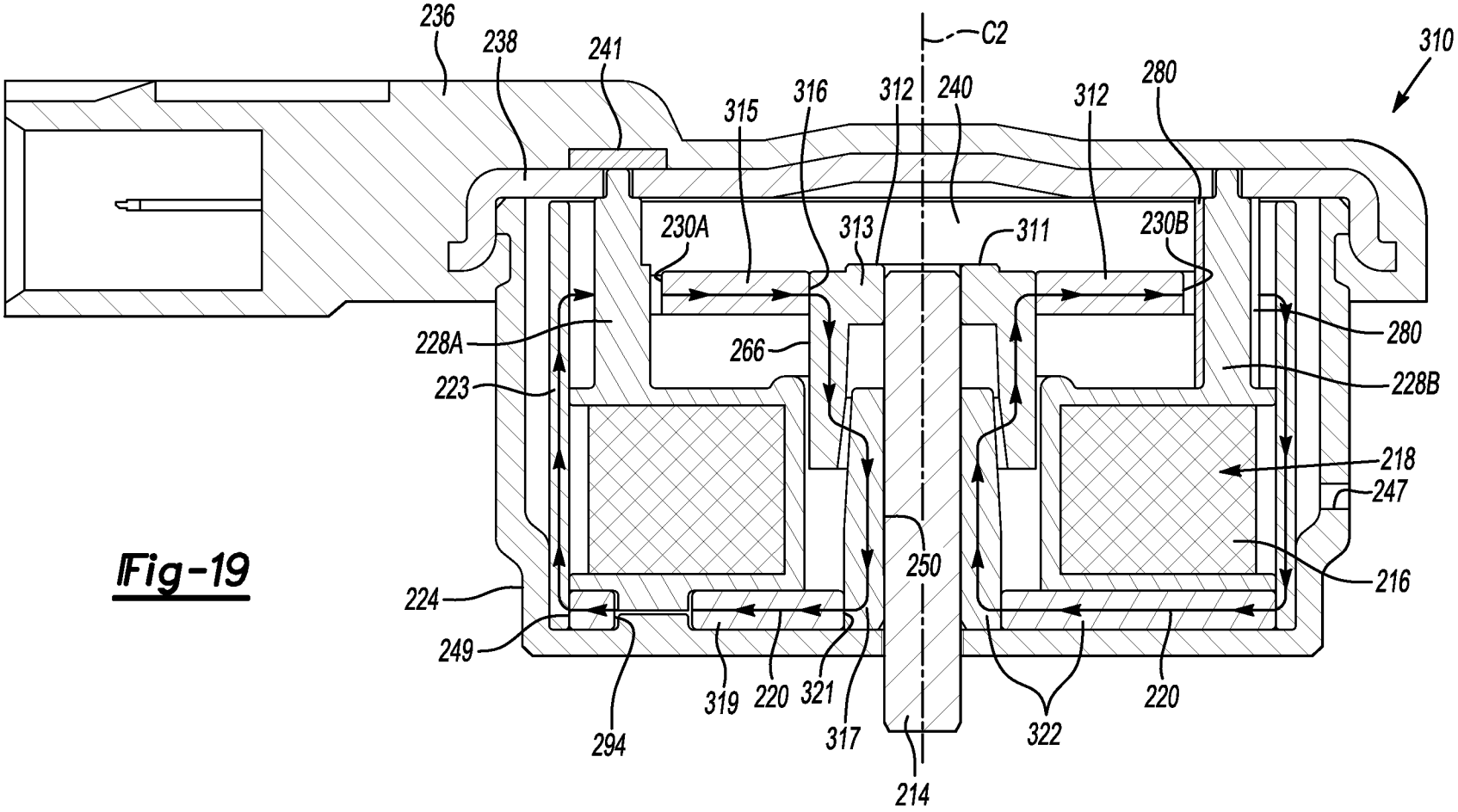
FIG. 19 is a schematic illustration in cross-sectional view of a solenoid assembly in another aspect of the present teachings, taken at lines 19-19 in FIG. 20.
Figure 20:
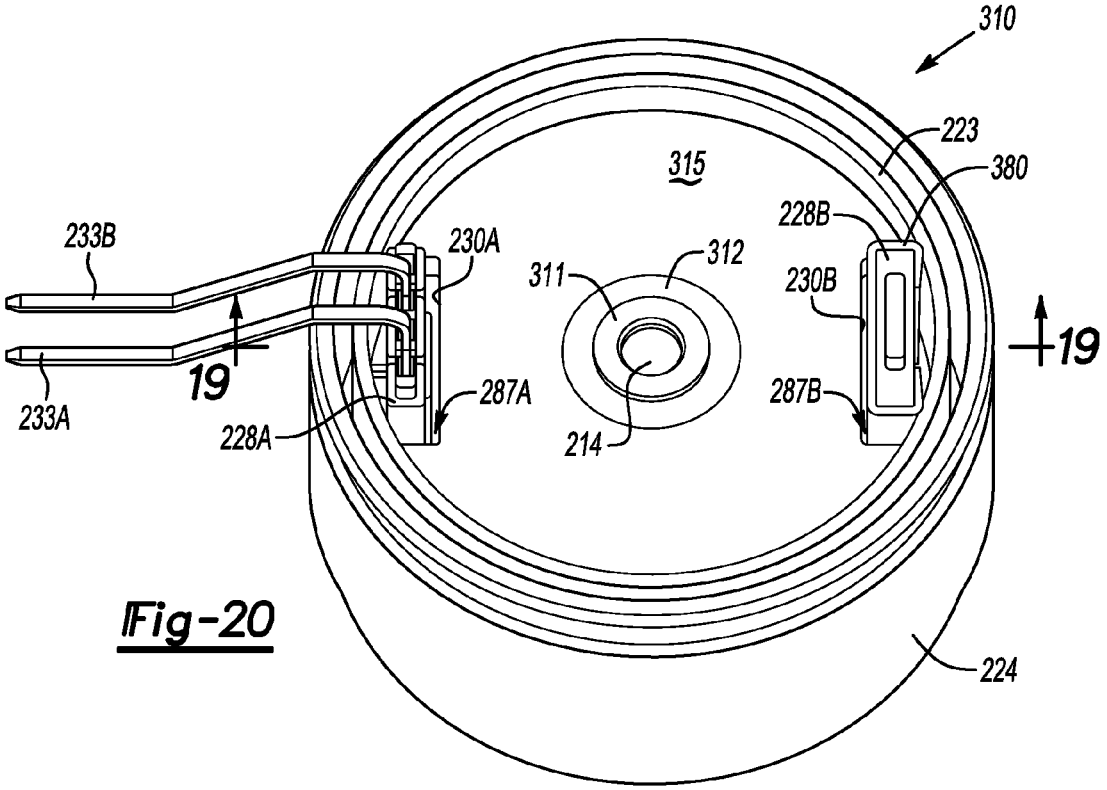
FIG. 20 is a schematic perspective illustration of the solenoid assembly of FIG. 14 with a cap, an overmolded portion, and a housing removed.
Figure 21:
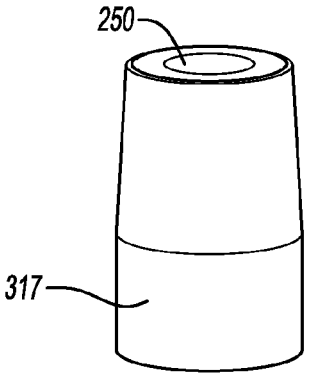
FIG. 21 is a schematic illustration in perspective view of a pole piece hub portion of the solenoid assembly of FIG. 19.
Figure 22:
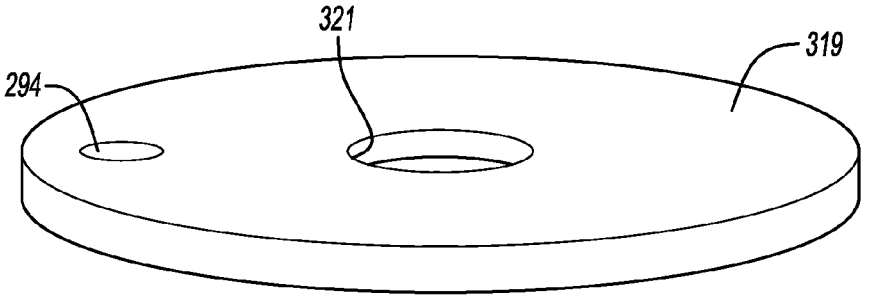
FIG. 22 is a schematic illustration in perspective view of a pole piece flange portion of the solenoid assembly of FIG. 19.
Figure 23:
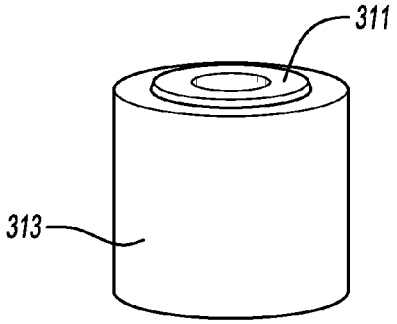
FIG. 23 is a schematic illustration in perspective view of an armature hub portion of the solenoid assembly of FIG. 19.
Figure 24:
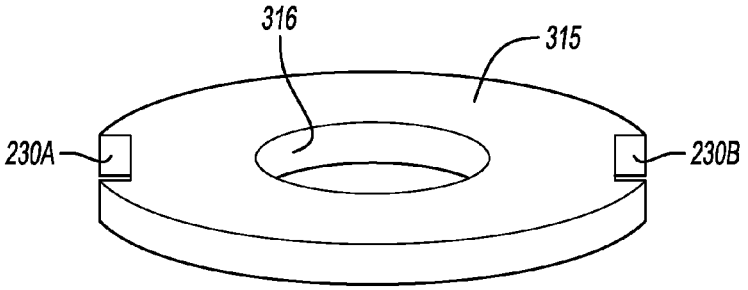
FIG. 24 is a schematic illustration in perspective view of an armature flange portion of the solenoid assembly of FIG. 19.

FIG. 19 shows a solenoid assembly 310 in another aspect of the present teachings that also uses the annular tubular member 223 to simplify the manufacturing of other components. The solenoid assembly 310 is identical in all aspects to the solenoid assembly 210 except that a two-piece armature 312 is used in place of armature 212, and a two piece pole-piece 322 is used in place of pole piece 222. Identical reference numbers are used for identical components.

The armature 312 is a two-piece armature that includes an armature hub portion 313 and an armature flange portion 315 press-fit to the armature hub portion 313. The armature flange portion 315 forms the openings 230A and 230B for the posts 228A, 228B. The armature hub portion 313 has a slight ridge 311 and includes the inner wall 266 described above. The armature flange portion 315 has a central opening 316 at which the armature hub portion 313 is press-fit to the armature flange portion 315. The two-piece configuration of the armature 312 enables the armature 312 to be stamped metal, which may present a costs savings over other materials, such as powdered metal. That is, each of the armature hub portion 313 and the armature flange portion 315 can be stamped magnetic or magnetizable metal components.

The pole piece 322 has a pole piece hub portion 317 and a pole piece flange portion 319 press-fit to the pole piece hub portion 317. The pole piece hub portion 317 includes the opening 250 for the pin 214. The pole piece flange portion 319 includes the opening 294 as a locating feature for the coil assembly 218 and the cap 224 relative to the pole piece 322, as described with respect to pole piece 222. The pole piece flange portion 319 has a central opening 321 at which the pole piece hub portion 317 is press-fit to the pole piece flange portion 319. The two-piece configuration of the pole piece 322 enables the pole piece 322 to be stamped metal, which may present a costs savings over other materials, such as powdered metal. That is, each of the pole piece hub portion 317 and the pole piece flange portion 319 can be stamped metal components.

The reference numbers used in the drawings and the specification along with the corresponding components are as follows:

10 solenoid assembly
12 armature
14 pin
16 coil
18 coil assembly
20 flux path
22 pole piece
24 solenoid housing
26 bobbin
28A first post
28B second post
30A first opening in armature
30B second opening in armature
32 base of armature
33A electrical terminal
33B electrical terminal
34 electrical connector
36 overmolded portion of cap
37 flange
38 cap
39 recess
40 cavity
42 fastener opening
44 first base of pole piece
46 first inner wall of pole piece
48 first outer wall of pole piece
50 center opening of pole piece
52 controlled clearance
54 portion of first inner wall with controlled clearance
56 portion of first inner wall without controlled clearance
57 aperture in housing
60 center opening of coil assembly
62 first side of coil assembly
66 second inner wall of armature
67 rim of armature
68 second outer wall of armature
69 rim of pole piece
70 stepped center opening of armature
72 first portion of stepped center opening
74 second portion of stepped center opening
75 tapered surface of armature
76 second side of coil assembly
77 tapered surface of pole piece
80 anti-rotation feature/ball bearing
82 ball
84 recess in housing
85 recess in armature
86 rim of housing
88 inner surface of housing
89 upper surface of armature base
90 outer surface of armature
94 locating feature/hole in pole piece
96 locating feature/dimple in bobbin
98 locating feature/dimple in housing
100 extension of second post
102 extension of first post
104 slots for terminals
106 slot in cap
108 slot in cap
110 solenoid assembly
112 armature
114 pin
116 coil
118 coil assembly
120 flux path
122 pole piece
124 solenoid housing
126 bobbin
128A first post
128B second post
130A first opening in armature
130B second opening in armature
131 bowed edge
132 base of armature
133A electrical terminal
133B electrical terminal
134 electrical connector
136 overmolded portion of cap
137 flange
138 cap
139 recess
140 cavity
141 elastomeric pad
142 fastener opening
143 slits in elastomeric pad
144 first base of pole piece
146 first inner wall of pole piece
147 drain hole
148 first outer wall of pole piece

150 center opening of pole piece
152 controlled clearance
154 portion of first inner wall with controlled clearance
156 portion of first inner wall without controlled clearance
157 aperture in housing
160 center opening of coil assembly
162 first side of coil assembly
166 second inner wall of armature
167 rim of armature
168 second outer wall of armature
169 rim of pole piece
170 stepped center opening of armature
172 first portion of stepped center opening
174 second portion of stepped center opening
175 tapered surface of armature
176 second side of coil assembly
177 tapered surface of pole piece
180 feature/sleeve
181A arm
181B arm
183A end
183B end
185 gap between arms of sleeve
187A first gap
187B second gap
194 locating feature/hole in pole piece
196 locating feature/dimple in bobbin
198 locating feature/dimple in housing
200 extension of second post
202 extension of first post
204 slots for terminals
206 slot in cap
208 slot in cap
210 solenoid assembly
212 armature
214 pin
216 coil
218 coil assembly
220 flux path
222 pole piece
223 tubular member
224 solenoid housing
226 bobbin
228A first post
228B second post
230A first opening in armature
230B second opening in armature
231 periphery of armature
232 base of armature
233A electrical terminal
233B electrical terminal
234 electrical connector
236 overmolded portion of cap
238 cap
239 recess
240 cavity
241 elastomeric pad
244 base of pole piece
246 inner wall of pole piece
247 drain hole
249 periphery of pole piece
250 center opening of pole piece
251 inner surface of tubular member
252 controlled clearance
254 portion of first inner wall with controlled clearance
256 portion of first inner wall without controlled clearance
257 aperture in housing
260 center opening of coil assembly
262 first side of coil assembly
266 inner wall of armature
270 stepped center opening of armature
272 first portion of stepped center opening
274 second portion of stepped center opening
275 tapered surface of armature
276 second side of coil assembly
277 tapered surface of pole piece
278 inner ridge of bobbin
280 feature/sleeve
281A arm
281B arm
283A end
283B end
285 gap between arms of sleeve
287A first gap
287B second gap
294 locating feature/hole in pole piece
296 locating feature/dimple in bobbin
298 locating feature/dimple in housing
300 extension of second post
302 extension of first post
304 slots for terminals
306 slot in cap
308 slot in cap
310 solenoid assembly
311 ridge of armature hub portion
312 armature
313 armature hub portion
315 armature flange portion
316 opening of armature flange portion
317 pole piece hub portion
319 pole piece flange portion
321 pole piece central opening
322 pole piece
C center axis
C1 center axis
C2 center axis
D inner diameter of tubular member
L length of travel
L1 length of travel
L2 length of travel While the best modes for carrying out the many aspects of the present teachings have been described in detail, those familiar with the art to which these teachings relate will recognize various alternative aspects for practicing the present teachings that are within the scope of the appended claims.

The invention claimed is:

1. A solenoid assembly comprising:

a coil assembly having:

a coil;

a bobbin surrounding the coil; and a first post that extends from the bobbin and through which electrical current is supplied to the coil;

a pole piece at least partially surrounding the coil assembly;

an armature at least partially surrounding the coil assembly; wherein the armature is configured to translate relative to the pole piece when the coil is energized; wherein the armature is configured so that the first post extends through the armature; and a feature configured to prevent the armature from contacting the first post when the armature translates.

2. The solenoid assembly of claim 1, wherein the coil is annular, and further comprising:

a substantially tubular member press-fit to the pole piece at a periphery of the pole piece to thereby surround the pole piece, the armature, and the coil assembly radially outward of the coil assembly.

3. The solenoid assembly of claim 2, wherein the pole piece and the armature are powdered metal.

4. The solenoid assembly of claim 2, wherein the armature includes an armature hub portion and an armature flange portion press-fit to the armature hub portion; wherein the armature flange portion extends radially outward from the armature hub portion;

wherein the pole piece includes a pole piece hub portion and a pole piece flange portion press-fit to the pole piece hub portion; wherein the pole piece flange portion extends radially outward from the pole piece hub portion; and wherein the tubular member is press-fit to the pole piece flange portion.

5. The solenoid assembly of claim 4, further comprising:

a pin extending from the armature and configured to move with the armature; and wherein the hub portion of the pole piece surrounds the pin radially outward of the pin and radially inward of the hub portion of the armature.

6. The solenoid assembly of claim 1, further comprising:

a substantially annular solenoid housing configured to contain the armature, the pole piece and the coil assembly; and wherein the feature is a ball bearing positioned between and contacting both the solenoid housing and the armature and configured to ride along the armature as the armature translates.

7. The solenoid assembly of claim 1, wherein the first post extends through a first opening in the armature; wherein the bobbin has a second post;

wherein the armature has a second opening through which the second post extends;

wherein the feature is a sleeve on one of the first post and the second post; and wherein the sleeve is configured to prevent the armature from contacting the first post and the second post.

8. The solenoid assembly of claim 7, wherein the sleeve is on the second post; wherein a gap defined between the sleeve and the second opening is smaller than a gap defined between the first post and the first opening so that the sleeve will stop rotation of the armature without the armature contacting the first post.

9. The solenoid assembly of claim 1, further comprising:

a substantially annular solenoid housing configured to contain the armature, the pole piece and the coil assembly; and a cap press-fit to the first post and the solenoid housing so that the cap and the solenoid housing together define a cavity in which the armature translates.

10. The solenoid assembly of claim 9, further comprising:

an electrical terminal extending along the first post to the coil;

an elastomeric pad on the cap; and wherein the electrical terminal extends through a slit in the elastomeric pad.

11. The solenoid assembly of claim 1, further comprising:

a substantially annular solenoid housing configured to contain the armature, the pole piece and the coil assembly;

wherein the pole piece has a locating feature; wherein the coil assembly and the solenoid housing have complementary locating features that interfit with the locating feature of the pole piece so that the pole piece and the coil assembly are positioned at a predetermined orientation within the solenoid housing.

12. The solenoid assembly of claim 1, wherein the coil assembly is generally annular and has opposing sides; wherein the pole piece surrounds a first of the opposing sides and the armature surrounds a second of the opposing sides; and wherein the pole piece and the armature are each configured to extend both radially inward and radially outward of the coil assembly so that, when the coil is energized, a magnetic flux path is established around the coil that travels only through the armature and the pole piece.

13. A solenoid assembly comprising:

a substantially annular coil assembly having:

a coil; and a bobbin with a first post and a second post both extending from the bobbin;

a pole piece at least partially surrounding the coil assembly;

an armature at least partially surrounding the coil assembly; wherein the armature has a first opening through which the first post extends and a second opening through which the second post extends; wherein the armature is configured to translate relative to the pole piece parallel to a center axis of the coil assembly when the coil is energized;

an electrical terminal extending along the first post and through which electrical current is supplied to the coil to cause the armature to translate;

a substantially tubular member press-fit to the pole piece at a periphery of the pole piece to thereby at least partially radially surround the pole piece, the armature, and the coil assembly; and a sleeve mounted on and substantially surrounding one of the first post and the second post to prevent the armature from contacting the first post and the second post.

14. The solenoid assembly of claim 13, wherein the pole piece and the armature are powdered metal.

15. The solenoid assembly of claim 13, wherein the armature includes an armature hub portion and an armature flange portion press-fit to the armature hub portion; wherein the armature flange portion extends radially outward from the armature hub portion;

wherein the pole piece includes a pole piece hub portion and a pole piece flange portion press-fit to the pole piece hub portion; wherein the pole piece flange portion extends radially outward from the pole piece hub portion; and wherein the substantially tubular member is press-fit to the pole piece flange portion.

16. The solenoid assembly of claim 15, further comprising:

a pin extending from the armature and configured to move with the armature; and wherein the hub portion of the pole piece surrounds the pin radially outward of the pin and radially inward of the hub portion of the armature.

17. The solenoid assembly of claim 13, wherein the sleeve is on the second post; wherein a gap defined between the sleeve and the second opening is smaller than a gap defined between the first post and the first opening so that the sleeve will stop rotation of the armature without the armature contacting the first post.

18. The solenoid assembly of claim 13, further comprising:

a substantially annular solenoid housing configured to contain the armature, the pole piece and the coil assembly; and a cap press-fit to the first post and the solenoid housing so that the cap and the solenoid housing together define a cavity in which the armature translates.

19. The solenoid assembly of claim 18, further comprising:

an electrical terminal extending along the first post to the coil;

an elastomeric pad on the cap; and wherein the electrical terminal extends through a slit in the elastomeric pad.

20. The solenoid assembly of claim 13, further comprising:

a substantially annular solenoid housing configured to contain the armature, the pole piece and the coil assembly;

wherein the pole piece has a locating feature; wherein the coil assembly and the solenoid housing have complementary locating features that interfit with the locating feature of the pole piece so that the pole piece and the coil assembly are positioned at a predetermined orientation within the solenoid housing.

* * * * *